US009565488B2

(12) United States Patent
Friza et al.

(10) Patent No.: US 9,565,488 B2
(45) Date of Patent: Feb. 7, 2017

(54) MICRO-ELECTRO-MECHANICAL SYSTEM DEVICES

(71) Applicant: Infineon Technologies AG, Neubiberg (DE)

(72) Inventors: Wolfgang Friza, Villach (AT); Alfons Dehe, Reutlingen (DE)

(73) Assignee: INFINEON TECHNOLOGIES AG, Neubiberg (DE)

( * ) Notice: Subject to any disclaimer, the term of this patent is extended or adjusted under 35 U.S.C. 154(b) by 0 days.

(21) Appl. No.: 14/716,940

(22) Filed: May 20, 2015

(65) Prior Publication Data

US 2016/0345084 A1 Nov. 24, 2016

(51) Int. Cl.

| | |
|---|---|
| ***H04R 1/02*** | (2006.01) |
| ***H04R 19/00*** | (2006.01) |
| ***H04R 19/02*** | (2006.01) |
| ***H04R 19/04*** | (2006.01) |

(52) U.S. Cl.

CPC ..... *H04R 1/023* (2013.01); *H04R 19/005* (2013.01); *H04R 19/02* (2013.01); *H04R 19/04* (2013.01); *H04R 2201/003* (2013.01)

(58) Field of Classification Search

CPC ..... H04R 19/04; H04R 19/005; H04R 1/08; H04R 9/08; H04R 11/04; H04R 17/02; H04R 21/02; H04R 1/02; H04R 1/025; H04R 1/026

USPC ..... 381/174–175, 369, 391, 392

See application file for complete search history.

(56) References Cited

U.S. PATENT DOCUMENTS

| | | | | |
|---|---|---|---|---|
| 6,088,463 A * | 7/2000 | Rombach | H04R 19/005 | 367/174 |
| 8,103,025 B2 * | 1/2012 | Mullenborn | H04R 19/005 | 381/174 |
| 8,447,057 B2 * | 5/2013 | Goida | H04R 1/02 | 381/175 |
| 2007/0071260 A1 * | 3/2007 | Mullenborn | H04R 19/005 | 381/175 |

OTHER PUBLICATIONS

Weisensee et al., "Hydrophobic and oleophobic re-entrant steel microstructures fabricated using micro electrical discharge machining", Journal of Micromechanics and Microengineering, 2014, 9 pages, vol. 24.

Hu et al., "Hierarchically structured re-entrant microstructures for superhydrophobic surfaces with extremely low hysteresis", Journal of Micromechanics and Microengineering, 2014, 9 pages, vol. 24.

* cited by examiner

*Primary Examiner* — Suhan Ni
(74) *Attorney, Agent, or Firm* — Viering, Jentschura & Partner mbB

(57) ABSTRACT

In various embodiments, a micro-electro-mechanical system device is provided. The micro-electro-mechanical system device may include a carrier, a particle filter structure coupled to the carrier, the particle filter structure comprising a grid, wherein the grid comprises a plurality of grid elements, each grid element comprising at least one through hole, and a micro-electro-mechanical system structure disposed on a side of the particle filter structure opposite the carrier. A height of the plurality of grid elements is greater than a width of the corresponding grid elements.

30 Claims, 20 Drawing Sheets

MICRO-ELECTRO-MECHANICAL SYSTEM DEVICES

TECHNICAL FIELD

Various embodiments relate generally to micro-electro-mechanical system devices.

BACKGROUND

A silicon microphone usually consists of an MEMS (micro-electro-mechanical system) chip (e.g. a silicon microphone) and an ASIC (application specific integrated circuit), which serves as a signal converter, which are assembled together into one SMD (surface mounting device) module. Such a microphone module will then usually be mounted on a printed circuit board by the respective manufacturer.

Such a silicon microphone usually includes a thin membrane and at least one stiff counter electrode (backplate), which have a direct contact to the environment via a sound channel. Due to this, they are vulnerable towards particles. In particular in case of a pressure impulse which may e.g. occur in a mobile phone, such particles are highly accelerated and may destroy the membrane upon impingement thereof, and may thus render the component unusable.

In order to protect these sensitive membranes, nowadays, one or more particle filters (mesh), usually made of plastic texture, are inserted into the sound channel in front of the printed circuit board (PCB), onto which the microphone module is mounted, during the manufacturing of a terminal device (e.g. of a mobile phone). However, this has to be provided for each single microphone and is very costly and labor intensive.

SUMMARY

In various embodiments, a micro-electro-mechanical system device is provided. The micro-electro-mechanical system device may include a carrier and a particle filter structure coupled to the carrier. The particle filter structure includes a grid. The grid includes a plurality of grid elements. Each grid element includes at least one through hole. The micro-electro-mechanical system device may further include a micro-electro-mechanical system structure disposed on a side of the particle filter structure opposite the carrier. A height of the plurality of grid elements is greater than a width of the corresponding grid elements.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

In various embodiments, a particle filter structure may be provided, which may be monolithically integrated with a substrate, for example a silicon substrate, of a micro-electro-mechanical system (MEMS) chip. The particle filter structure may be provided in a cavity below the MEMS chip and protects the MEMS chip from potentially damaging particles which may otherwise enter the cavity and contact the MEMS chip. In the examplary implementation of the MEMS device as a microphone module or as a loudspeaker module, the particle filter structure may be provided in the sound channel of the MEMS chip.

Using the conventional methods of manufacturing MEMS chips it is provided to monolithically integrate a grid into the sound channel of the MEMS chip already during the manufacturing of the MEMS chip. This may provide the possibility to configure the grid such that it has the effect of a particle filter structure. In this case, the installation of the particle filter structure is carried out on wafer level.

The adjustment of the particle filter structure on the sound channel is precise, since the adjustment accuracy of equipment for manufacturing semiconductor components can be used for the manufacturing of the grid and thus for the particle filter structure. Since the particle filter structure is installed on wafer level, the costs for this additional structure within the MEMS device distribute over the number of MEMS chips in the wafer.

Figure 1A:
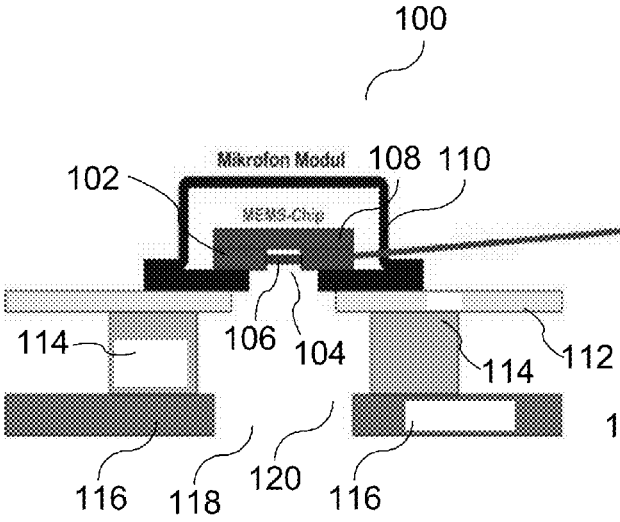
FIGS. 1A and 1B show a cross sectional view of a microphone module in accordance with various embodiments (FIG. 1A) and an enlarged view of a portion of a particle filter structure in accordance with various embodiments (FIG. 1B)
Figure 1B:
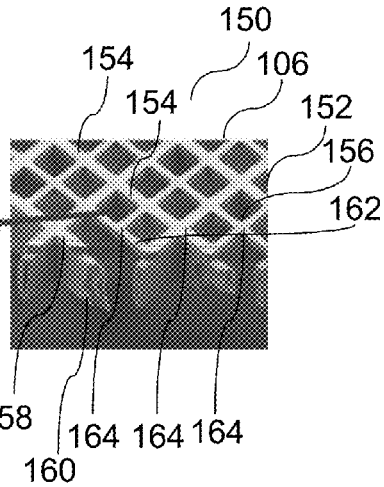

FIGS. 1A and 1B show a cross sectional view of a microphone module 100 is one implementation of a MEMS device in accordance with various embodiments (FIG. 1A) and an enlarged view 150 of a portion of a particle filter structure in accordance with various embodiments (FIG. 1B). It is to be noted, also the following description illustrates various embodiments using a microphone module as an example of a MEMS device, various embodiments may be provided in any other type of MEMS device such as for example a loudspeaker device or a sensor device such as for example a pressure sensor device or a gas sensor device and the like.

As shown in FIG. 1A, the microphone module 100 may include a first carrier 102, for example a substrate 102, for example a silicon substrate 102. It is to be noted that the first carrier 102 may be made of any other semiconductor material, for example a compound semiconductor material. The first carrier 102 may include at least one cavity 104 and a particle filter structure 106 monolithically integrated with the first carrier 102. Furthermore, a MEMS chip 108 (e.g. a microphone chip 108) may be arranged over the first carrier 102 covering the cavity 104. Illustratively, the cavity 104 may form a sound channel of the microphone chip 108, and the particle filter structure 106 may be arranged within the sound channel 104 to protect for example the membrane and the electrodes of the microphone chip 108 from impinging particles, which may enter the cavity 104. The microphone module 100 may further include a housing 110, which accommodates the microphone chip 108 and the first carrier 102 including the particle filter structure 106. The housing 110 may in turn be arranged on a second carrier 112 such as a printed circuit board (PCB). The housing 110 as well as the PCB 112 may include a through hole in the extension of the sound channel to allow free access of sound waves to the sound channel. Furthermore, an outer housing 116 may be provided which accommodates the microphone housing 110 as well as the PCB 112. The outer housing 116 supports the PCB 112 via spacer elements 114, wherein the spacer elements 114 may be made of electrically insulating material. The outer housing 116 also includes a through hole 118 which forms a total through hole 120 to the sound channel 104 of the microphone chip 108 to allow free access of sound waves to the sound channel.

Now referring to FIG. 1B, the particle filter structure 106 will be explained in more detail. The particle filter structure 106 may be coupled to (for example monolithically integrated with) the first carrier 102. The particle filter structure 106 may include a grid 152. The grid 152 may include a plurality of grid elements 154. Each grid element 154 may include at least one through hole 156. In various embodiments, each grid element 154 may include two, three, four, five, or even more through holes 156. In various embodiments, each grid element 154 may include exactly 4 through holes 156. Each grid element 154 may include a boundary structure 158, which may include a layer stack formed by a plurality of for example two layers, thereby forming deeper ridges 160, and for example two inner ridges 162 respectively connecting two respectively opposite boundary ridges of the boundary structure 158. The two inner ridges 162 may cross each other to form a crossing point 164 in the middle of the respective grid element 154. The crossing point 164 as well as the inner ridges 162 may be formed only by one layer and may be thinner than the boundary ridges of the boundary structure 158. The grid 152 may be formed by one or more materials, for example by silicon, for example by amorphous silicon and/or polysilicon. In various embodiments, the grid 152 may be formed by the same material as the first carrier 102, for example the substrate 102. As an alternative, the grid 152 may be formed by a material which is different from the material of the first carrier for 102. The grid may be monolithically integrated with the substrate 102.

FIGS. 2A to 2D show cross-sectional views illustrating a process of manufacturing the grid 152 in accordance with various embodiments.

Figure 2A:
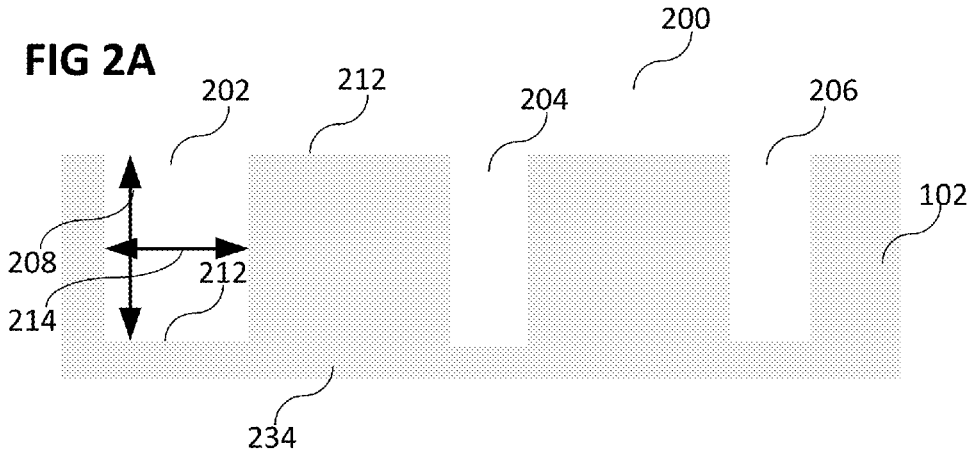
FIGS. 2A to 2D show cross-sectional views illustrating a process of manufacturing a grid in accordance with various embodiments.

By way of example, as shown in a first cross-sectional view 200 in FIG. 2A, a plurality of trenches, for example a first trench 202, a second trench 204, and a third trend 206 (in general any number of trenches) may be formed into the substrate 102 in a region which should be arranged in the sound channel of the microphone module 100 to be manufactured. The trenches 202, 204, 206 may be etched using an etching process, for example and anisotropic etching process, for example a dry etching process. The trenches 202, 204, 206 may be formed to have a depth in the range from about 5 μm to about 20 μm, for example in the range from about 7.5 μm to about 12.5 μm (symbolized in FIG. 2A by a first arrow 208) calculated from a top surface 210 of the substrate 102 to the bottom 212 of the respective trench 202, 24, 206. Furthermore, the trenches 202, 204, 206 may be formed to have a width (symbolized in FIG. 2A by a second arrow 214) in the range from about 0.5 μm to about 4 μm, for example in the range from about 1.5 μm to about 3 μm. As will be described in more detail below, the width of a respective trench should be twice the thickness of a lining layer and a filling layer at maximum, as will be described in more detail below.

Figure 2B:
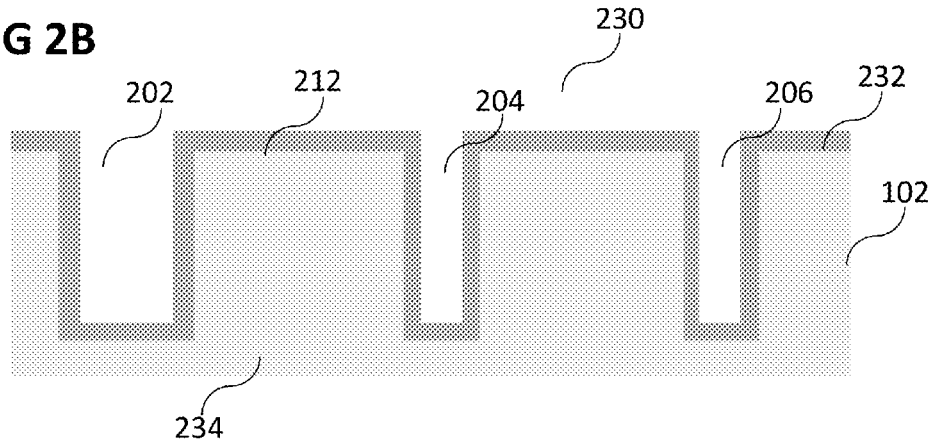

Furthermore, as shown in a second cross-sectional view 230 in FIG. 2B, a (conformal) lining oxide layer 232 may be formed in the plurality of trenches 202, 204, 206 from insulating material. The lining oxide layer 232 may serve as an etch stop layer when removing the underlying bulk material 234 of the substrate 102, for example the underlying bulk silicon material 234. Alternatively, structures 244 (see e.g. FIG. 2C) may be processed by CMP (chemical mechanical polishing) of poly silicon stopping on the stopping oxide, in other words, the lining oxide layer 232. Then, the structure 244 may have a rather U shape cross section since it is not thinned in the trench bottom.

Figure 2C:
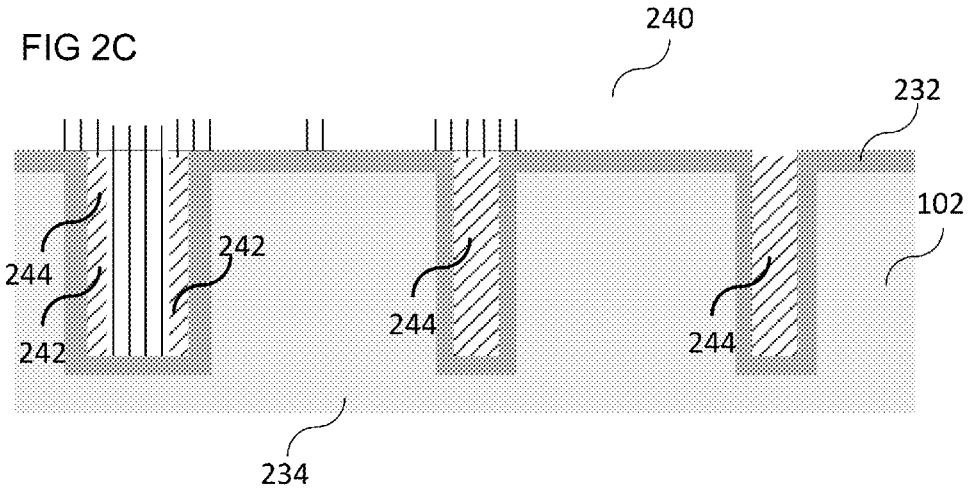

Moreover, as shown in a third cross-sectional view 240 in FIG. 2C, optionally, the trenches 202, 204, 206 may then be at least partially filled with amorphous silicon 242 (which may be n-doped, e.g. with Phosphorous or p-doped, e.g. with Boron). Then, using for example an etching process, for example an anisotropic etching process, for example a dry etching process, and a corresponding etching mask, some trenches are formed. In the example, the second trench 204 and the third trench 206 are substantially completely filled with the amorphous silicon, and in some trenches, in the example in the first trench 202 sidewall spacers 244 made of the amorphous silicon are formed. In this context, it could be mentioned that if the respective trench has a slight bottle neck, a narrow point develops inside the filled trench. Due to the free surface, this may eventually help to release the stress of the structure during successive annealing. In various embodiments, the sidewall spacers 244 may have a wall thickness in the range form about 1.0 μm to about 2.0 μm, e.g. in the range from about 12 μm to about 1.8 μm, e.g. in the range from about 1.3 μm to about 1.5 μm, e.g. about 1.4 μm.

Figure 2D:
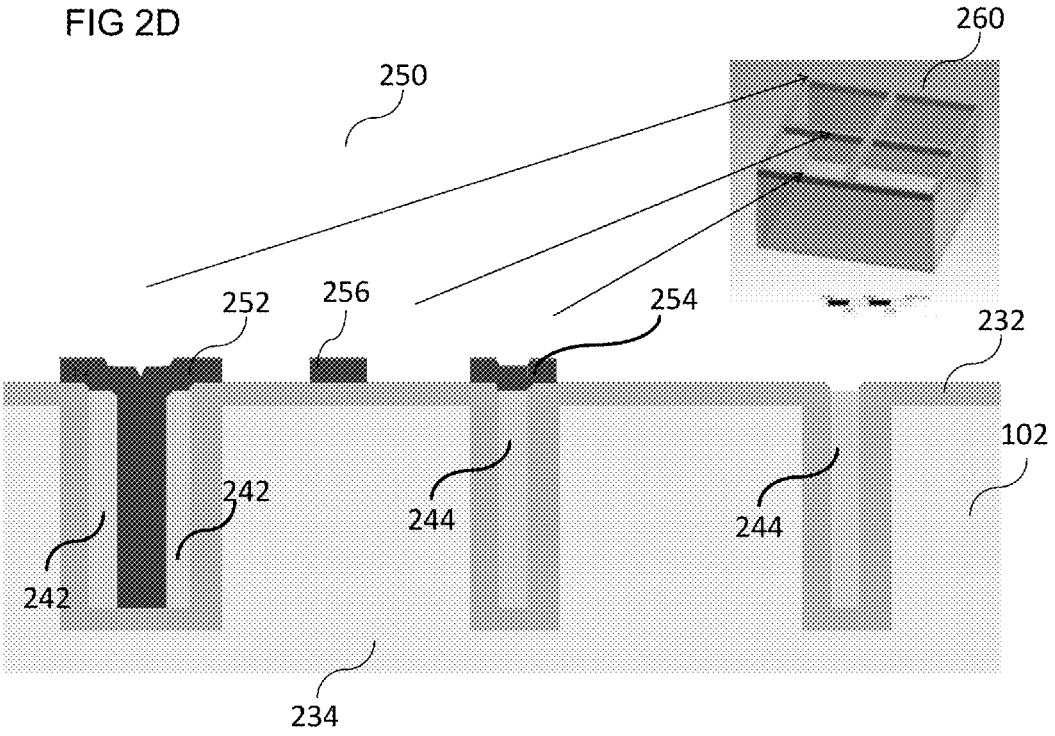

Then, as shown in a fourth cross-sectional view 250 in FIG. 2D, the grid elements 252, 254, 256 may be formed by depositing polysilicon over the structure of FIG. 2C. Depending for example on whether sidewall spacers 244 were formed in the previous process within the respective trench or whether the respective trench remained completely filled, different types of grid elements 252, 254, 256 may be formed. By way of example, in one or more regions, the top lying polysilicon layer may be structured to become a functional layer such as for example a first grid portion 252 having a T shape, for example serving as an electrode. As an alternative, the top lying polysilicon layer may be thinned down to the silicon oxide level, to generate the pure shape of the ridges. In various embodiments, the respective trench is not filled by the deposited polysilicon layer, but is completely filled with the amorphous silicon 244, the deposited polysilicon is formed over the respective trench and on the amorphous silicon 244 and may form a second grid portion 254 without a ridge. A ridge 258 may have a thickness in the range from about 1.5 μm to about 2.5 μm, e.g. in the range from about 1.7 μm to about 2.3 μm, e.g. in the range from about 1.8 μm to about 2.0 μm, e.g. about 1.9 μm. The same holds true for those portions of the structured deposited polysilicon formed directly on the lining oxide layer 232, such as e.g. a third grid portion 256. FIG. 2D further shows the mapping of the respective grid portions 252, 254, 256 to one grid element 260 of a plurality of grid elements forming the grid.

Having outlined the general process in principle to form the embedded structure from which the grid elements and the grid may be formed in a bulk silicon material 234, various processes to manufacture the monolithically integrated grid structure will be described in more detail below.

Then, the MEMS will be fabricated over the structure as described for example with respect to FIG. 2D, including, for example, forming an additional backplate (in other words the counter electrode) (in embodiments in which the grid does not also serve as a backplate in addition to its function of a particle filter), forming one or more sacrificial layers, and for example forming a membrane, for example a silicon membrane, etc.

Figure 3A:
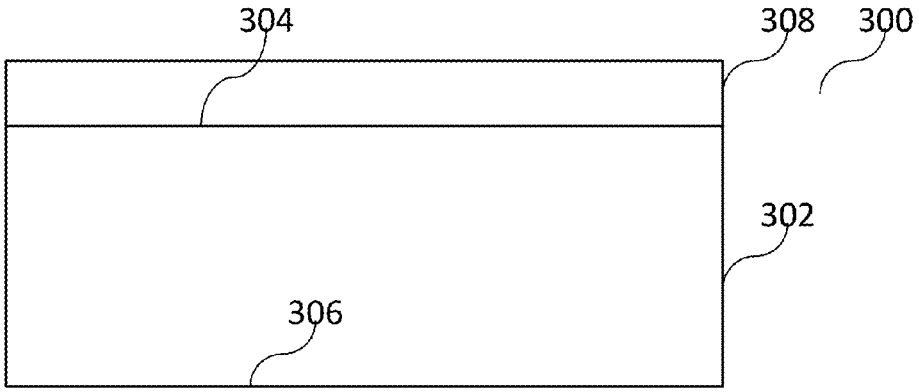
FIGS. 3A and 3B show cross-sectional views of a conventional process of forming of a cavity in a MEMS device.
Figure 3B:
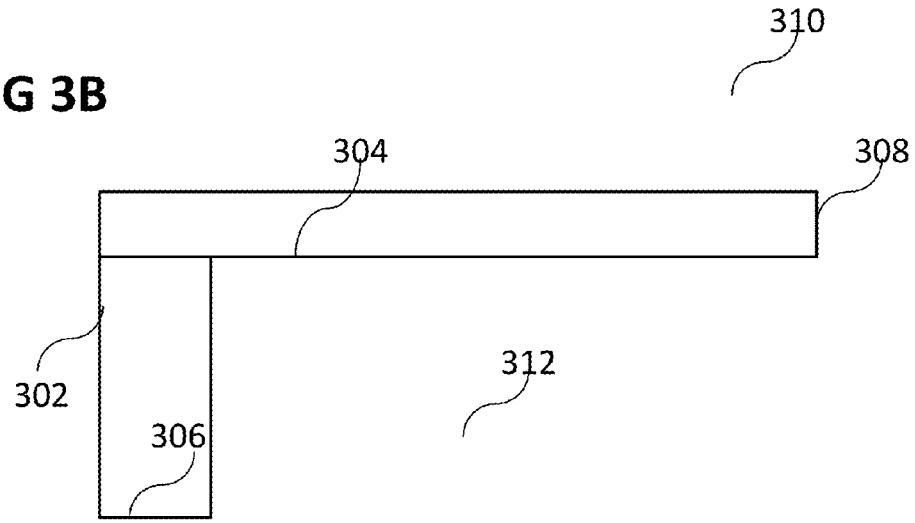

FIGS. 3A and 3B show cross-sectional views of a conventional process of forming of a cavity in a MEMS device in accordance with various embodiments.

As shown in FIG. 3A, in a first process stage as shown in a first cross-sectional view 300, a substrate 302 is provided, for example made of silicon or another suitable semiconductor material or semiconductor compound material. The substrate has a front side 304 and a rear side 306. A MEMS structure 308 is manufactured over the front side 304 of the substrate 302. A rear side trench etching process (in other words an etch process applied to the rear side 306 of the substrate 302) is applied to the rear side 306 of the substrate 302 to form one or more cavities 312 and to expose a portion of the MEMS structure 308, which was in physical contact with the substrate 302. In this way, by way of example, a sound channel may be formed by the one or more cavities 312 for example to a membrane (not shown) of the MEMS structure 308, for example in the embodiments in which the MEMS structure 308 is configured as a loudspeaker or a microphone (see e.g. a second process stage as shown in a second cross-sectional view 310 in FIG. 3B).

Figure 4A:
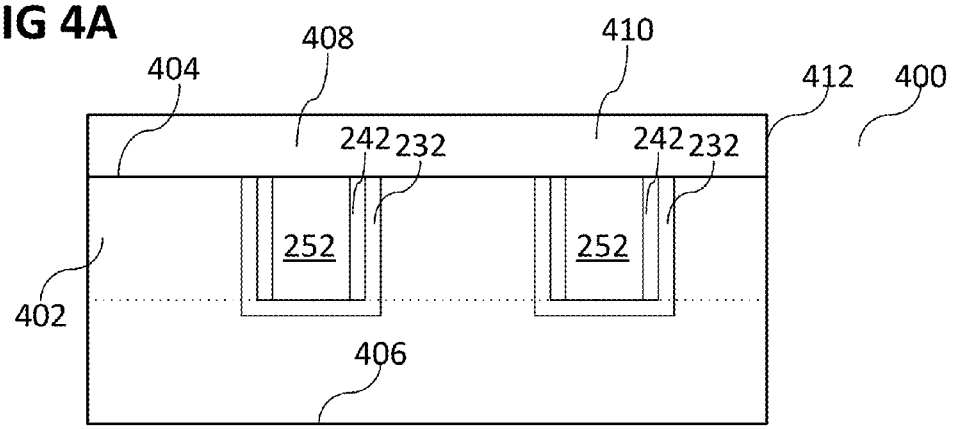
FIGS. 4A and 4B show cross-sectional views of a process of manufacturing of a MEMS device having a monolithically integrated particle filter in accordance with various embodiments.
Figure 4B:
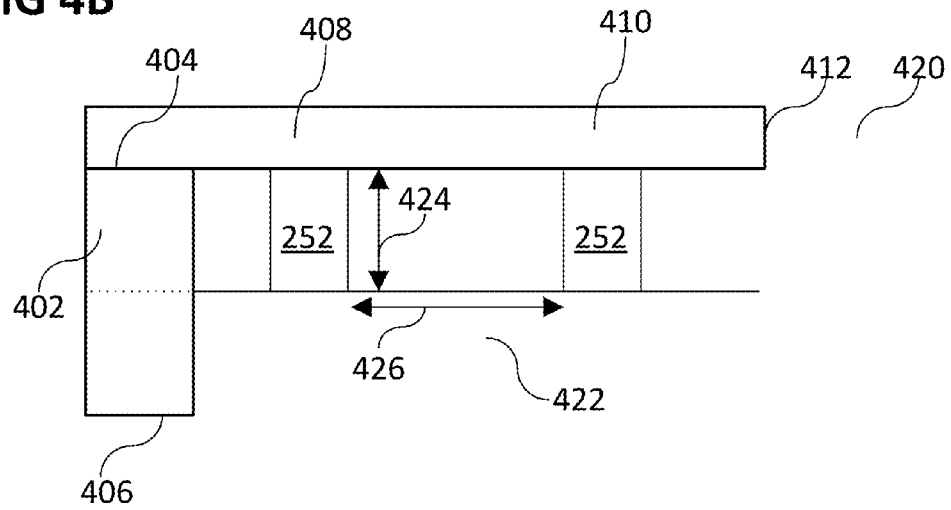

FIGS. 4A and 4B show cross-sectional views of a process of manufacturing of a MEMS device having a monolithically integrated particle filter in accordance with various embodiments.

In a first process stage, as shown in a first cross-sectional view 400 in FIG. 4A, a substrate 402 is provided having a front side 404 and a rear side 406. This process stage is following the process stage as shown in FIG. 2D, that is the trenches and grid elements 408, 410 are already formed within the substrate 402, wherein in this example configuration, only grid elements 408, 410 are shown, in which (at this process stage) there are also provided the sidewall spacers 244 made of amorphous silicon 242, and in which the top lying polysilicon layer 252 may be thinned down to the silicon oxide level, to generate the pure shape of the ridges. However, in the first process stage, the grid elements 408, 410 are not yet exposed. Furthermore, a MEMS structure 412, which may be similar to the MEMS structure 308 as shown in FIG. 3A or to the MEMS chip 108 as shown in FIG. 1A, may be formed on the front side 404 surface of the substrate 402 and may thus be in physical contact with the front side 404 surface of the substrate 402 and the upper surface of the polysilicon 252. It is to be noted that the processes may also start from other configurations as the one described in these embodiments.

In order to continue to a second process stage, as shown in a second cross-sectional view 420 in FIG. 4B, a rear side trench etching process (in other words an (unisotropic) etch process applied to the rear side 406 of the substrate 402) is applied to the rear side 406 of the substrate 402 to form one or more cavities 422 and to expose a portion of the MEMS structure 412, which was in physical contact with the substrate 402. This etching process may also remove the lining oxide layer 232 and the sidewall spacers 242 (in various embodiments, the sidewall spacers 242 are made of polysilicon and may not be removed after removing of the lining stop oxide, in other words the lining oxide layer 232). However, this etching process is selective to the polysilicon 252 and does not (or substantially does not) remove the polysilicon 252. It is to be noted that the grid elements 408, 410 made of polysilicon 252 are fixed in the substrate 402, in other words, the grid is anchored in the substrate 402 and only those grid elements 408, 410 being arranged in the region(s) of the one or more cavities 422 are exposed and has form a particle filter being for example arranged in the sound channel (which may be formed by the one or more cavities 422) of a microphone or a loudspeaker as an example configuration of the MEMS structure 412. In various embodiments, the micro-electro-mechanical system structure is disposed on a side of the particle filter structure opposite the carrier.

In various embodiments, the height (symbolized in FIG. 4B by a first arrow 424) of the exposed polysilicon elements, in other words of the exposed grid elements 408, 410, may be in the range from about 5 μm to about 15 μm, for example in the range from about 6 μm to about 14 μm, for example in the range from about 7 μm to about 13 μm. The height 424 has a substantial effect on the stiffness of the formed particle filter. In other words, the larger the height 424 is selected, the stiffer the particle filter will become. Illustratively, as shown in FIG. 4B, the polysilicon elements 252 function as a grid and thus as the particle filter.

The lateral (edge-to-edge) distance (symbolized in FIG. 4B by a second arrow 426) between the polysilicon elements 252 may be the same for all exposed grid elements or even for all trenches formed in the previous processes or it may vary depending on the desired design of the particle filter to be formed. In various embodiments, the lateral distance 426, which may also be referred to as the mesh width of the formed grid, may be in the range from about 2 μm to about 200 μm, for example in the range from about 5 μm to about 20 μm.

Thus, in various embodiments, the height 424 of the plurality of grid elements is greater than a width (symbolized in FIG. 4B by a third arrow 428) of the corresponding grid elements.

As shown in FIG. 4B, this configuration provides a MEMS device including a cavity, which may serve as a sound channel, in which the particle filter is in direct physical contact with the lowermost layer of the MEMS structure 412.

Figure 5A:
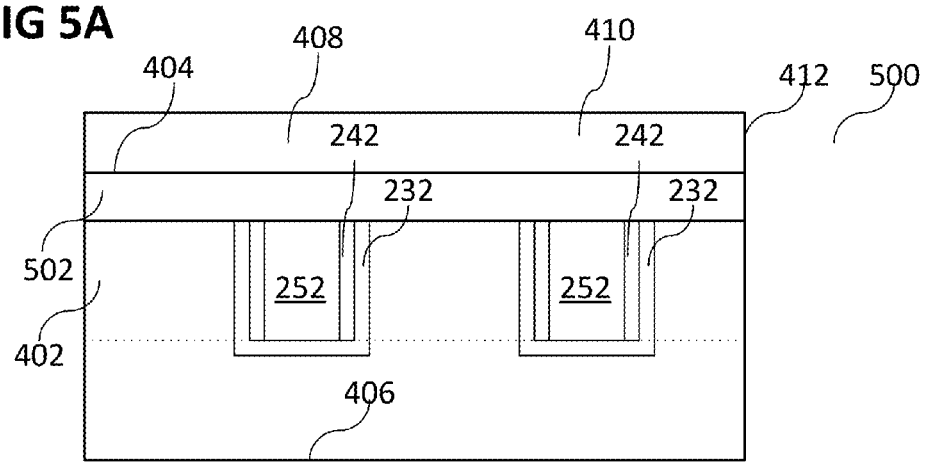
FIGS. 5A and 5B show cross-sectional views of a process of manufacturing of a MEMS device having a monolithically integrated particle filter in accordance with various embodiments.
Figure 5B:
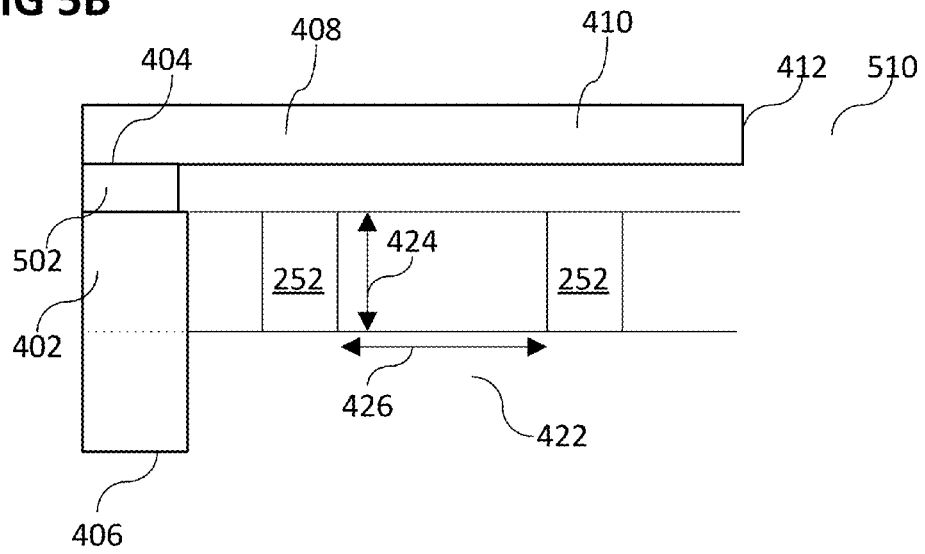

FIGS. 5A and 5B show cross-sectional views of a process of manufacturing of a MEMS device having a monolithically integrated particle filter in accordance with various embodiments.

The first process stage as shown in a first cross-sectional view 500 in FIG. 5A is similar to the first process stage as shown in the first cross-sectional view 400 in FIG. 4A, and therefore only the differences will be described in more detail below.

In the configuration as shown in FIG. 5A, the structure may further include an additional layer 502, for example an electrically insulating layer 502 such as for example an oxide layer 502, for example a silicon oxide layer 502 sandwiched between the substrate 402 and the MEMS structure 412. In various embodiments, the additional layer 502 may have a layer thickness in the range from about 0.1 μm to about 5 μm, for example in the range from about 0.5 μm to about 2 μm. It is to be noted that in various embodiments, the additional layer 502 may also be formed by an electrically conductive layer or a semiconductive layer such as for example polysilicon.

While applying the back etch process as described with reference to FIG. 4B, also a portion of the additional layer 502 will be removed in this case to form the cavity 422 to expose the lower portion of the MEMS structure 412 to the cavity 422, for example the sound channel (as shown in a second cross-sectional view 510 illustrating a second process stage of this configuration in FIG. 5B). In various embodiments, the exposed polysilicon elements 252 may be arranged at a distance to the lowermost layer of the MEMS structure 412. Thus, the exposed polysilicon elements 252 may only be held by the substrate 402, into which the grid elements 408, 410 are anchored.

FIGS. 6A to 6F show cross-sectional views of a process of manufacturing of a MEMS device having a monolithically integrated particle filter in accordance with various embodiments. In various embodiments, the grid may be formed illustratively by two grids stacked above one another. In other words, the grid may include two layers, wherein one layer may serve as a stabilization element and one layer may serve as an electrode. However, the grid also in accordance with these embodiments functions as a particle filter.

Figure 6A:
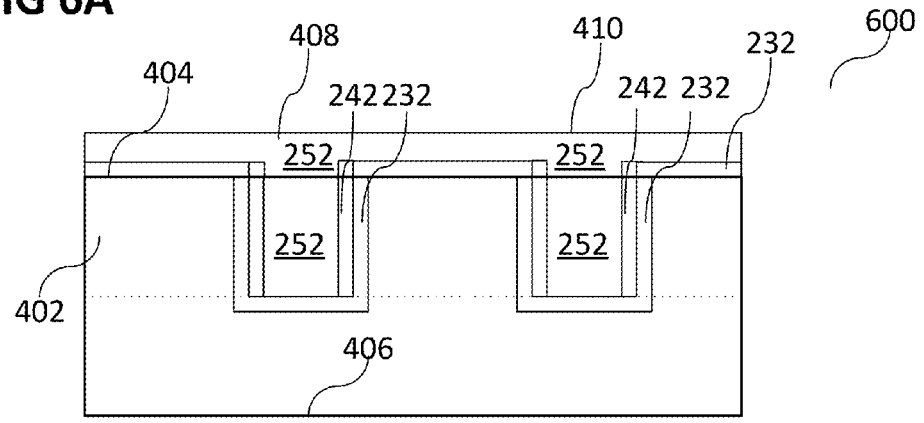
FIGS. 6A to 6F show cross-sectional views of a process of manufacturing of a MEMS device having a monolithically integrated particle filter in accordance with various embodiments.

FIG. 6A shows in a first cross-sectional view 600 a first process stage, which is similar to the process stage of FIG. 2D. As shown in FIG. 6A, the lining oxide layer 232 still covers the entire surface of the substrate 402. Furthermore, also the polysilicon 252 has not been removed yet from the substrate 402 and thus covers the entire surface of the lining oxide layer 232. The thickness of the polysilicon 252 over the horizontal surface of the lining oxide layer 232 may be in the range from about 0.5 μm to about 5 μm, for example in the range from about 1 μm to about 2 μm. Thus, in various embodiments, the thickness of the polysilicon 252 over the upper surface 404 of the substrate 402 and the lining oxide layer 232 may be rather thin, so that the thus provided layer is a thin layer which may be provided to using a planar process which may be implemented by a conformal deposition of the polysilicon 252. This horizontal leg of the T-structure may serve as an electrode. Thus, in various embodiments, in which the grid is formed by two or more grid layers or grid portions, the stabilizing portion such as the horizontal leg of the T-structure, may be formed of an electrically insulating material such as e.g. an oxide (e.g. silicon oxide) or a nitride (e.g. silicon nitride). Furthermore, the horizontal leg of the T-structure may have a width in the range from about 0.5 μm to about 4 μm, e.g. in the range from about 1 μm to about 2 μm. In various embodiments, the horizontal leg of the T-structure may have a dimension or size sufficiently large to provide a sufficient electrical capacity so that it can function as an electrode, e.g. as a backplate electrode of the MEMS device, e.g. of the microphone or the loudspeaker. Furthermore, in various embodiments, the material forming the horizontal leg of the T-structure may be the same as or may be different from the material of the vertical leg of the T-structure. Illustratively, in various embodiments, the grid having a plurality of grids or grid layers, e.g. having such a T-structure as described above, may provide a double functionality, i.e. it may function as an electrode (e.g. as a backplate) of the MEMS device, and at the same time it may function as a particle filter with e.g. the vertical leg of the T-structure serving as the main stabilizing element and thus functioning as a particle filter. Moreover, in various embodiments, the two grids (e.g. the horizontal leg and the vertical leg of the T-structure) of the total grid may be electrically decoupled form each other. It should be noted that it is not necessary that the "upper" grid layer laterally extends over the "lower" grid layer supporting the "upper" grid layer. The "upper" grid layer may have the same lateral extension as the "lower" grid layer or even may be smaller.

The shape of the respective grid elements (in top view) may in general be arbitrary, e.g. it may be round (e.g. circular or elliptical), it may have a triangular shape or a rectangular (e.g. quadratic) shape or a regular or irregular shape having 4 or even more corners.

Furthermore, as will be described in more detail below, a first mesh width of the "lower" grid formed e.g. by the "lower" grid layer may be the same as or may be different from a second mesh width of the "upper" grid formed e.g. by the "upper" grid layer. In various embodiments, the "lower" grid may have larger mesh width than the "upper" grid (in other words, the first mesh width may be larger than the second mesh width).

Figure 6B:
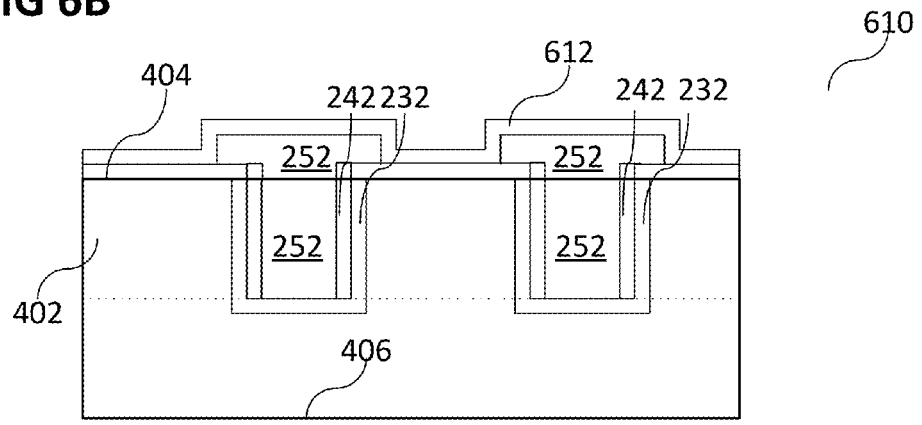

Then, as shown in a second cross-sectional view 610 in FIG. 6B (which represents a second process stage), the polysilicon 252 may be patterned to form a plurality of T-shape grid structures. Then, a further lining oxide layer 612 (e.g. made of silicon oxide), which may be made from the same or a different material than the lining oxide layer 232, may be deposited over the entire upper surface of the patterned structure (alternatively, the T structure may be embedded in the top lying oxide layer that is finally planarized by an oxide CMP stopping on the polysilicon T structure and then further growing oxide layer 622).

Figure 6C:
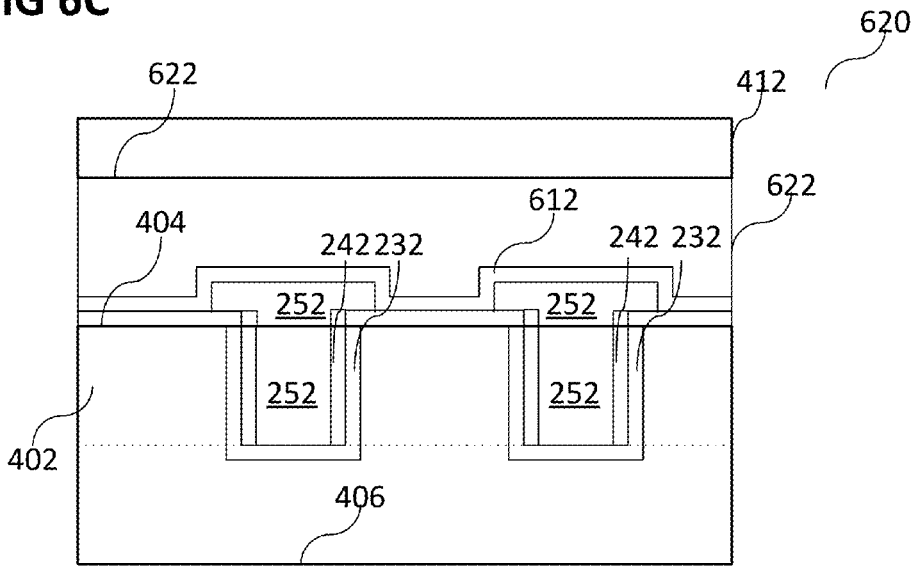

Furthermore, as shown in a third cross-sectional view 620 in FIG. 6C representing a third process stage, a an oxide layer 622 that may serve as a sacrificial layer to space the T structure backplate from the top lying MEMS membrane 412 may be deposited over the further lining oxide layer 612. The oxide layer 622 may have a layer thickness in the range from about 0.5 μm to about 5 μm, for example in the range from about 1 μm to about 2 μm. Then, the MEMS structure 412 (e.g. a polysilicon membrane of a microphone), which may be similar to the MEMS structure 308 as shown in FIG. 3A or to the MEMS chip 108 as shown in FIG. 1A, may be formed on a front side 624 surface of the polysilicon layer 622 and may thus be in physical contact with the front side 624 surface of the polysilicon layer 622. This may include forming one or more backplates, one or more sacrificial layers, one or more membranes coupled to one or more electrodes, and the like.

Then, the cavity 632 from the rear side may be opened stopping on the oxide layer 634. Illustratively, the oxide layers 634, 612, 622 may be etched selectively against the polysilicon 525, 242 to release the MEMS structure 412.

Figure 6D:
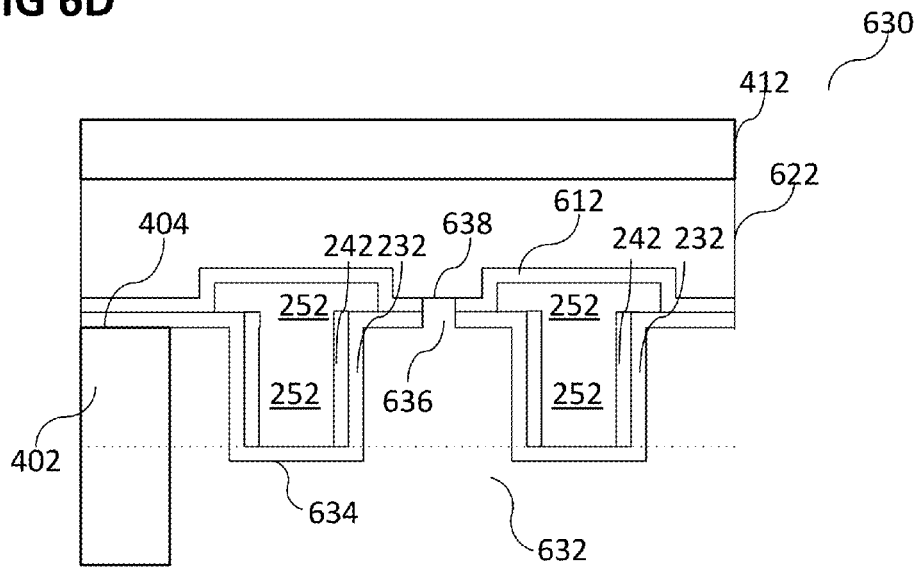

As an alternative process, as shown with reference to FIG. 6D illustrating a fourth cross-sectional view 630 representing a fourth process stage, a first rear side trench etching process (in other words a first etch process applied to the rear side 406 of the substrate 402) is applied to the rear side 406 of the substrate 402 to form one or more first cavity portions 632. With the first rear side trench etching process, the bottom surface 634 of the lining oxide layer 232 may be exposed. Then, an opening 636 may be formed through the lining oxide layer 232 and the further lining oxide layer 612 may be etched between two respective T-structures. Thus, a portion 638 of a rear surface of the polysilicon layer 622 may be exposed. Illustratively, the lining oxide layer 232 and the further lining oxide layer 612 protect the polysilicon 252 from being removed during the first rear side trench etching process and the etch process used for forming the opening 636. The exposed portion 638 of the rear surface of the polysilicon layer 622 may serve as a starting point for a second rear side trench etching process as will be described in more detail below.

Figure 6E:
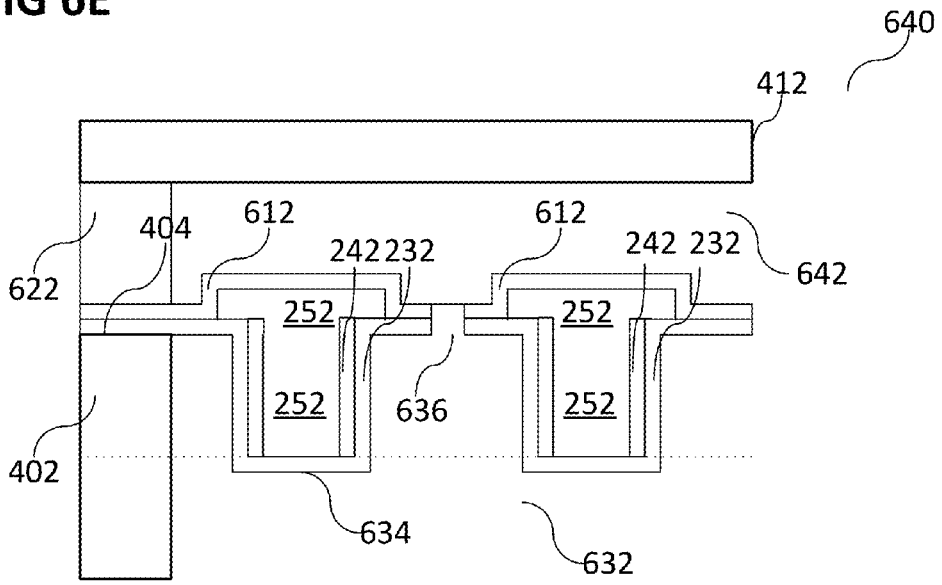

With reference to FIG. 6E illustrating a fifth cross-sectional view 640 representing a fifth process stage, a portion of the polysilicon layer 622 may be removed using the second rear side trench etching process through the opening 636 to expose a portion of the MEMS structure 412, which was in physical contact with the polysilicon layer 622. Thus, one or more second cavity portions 642 above the further lining oxide layer 612 may be formed.

Figure 6F:
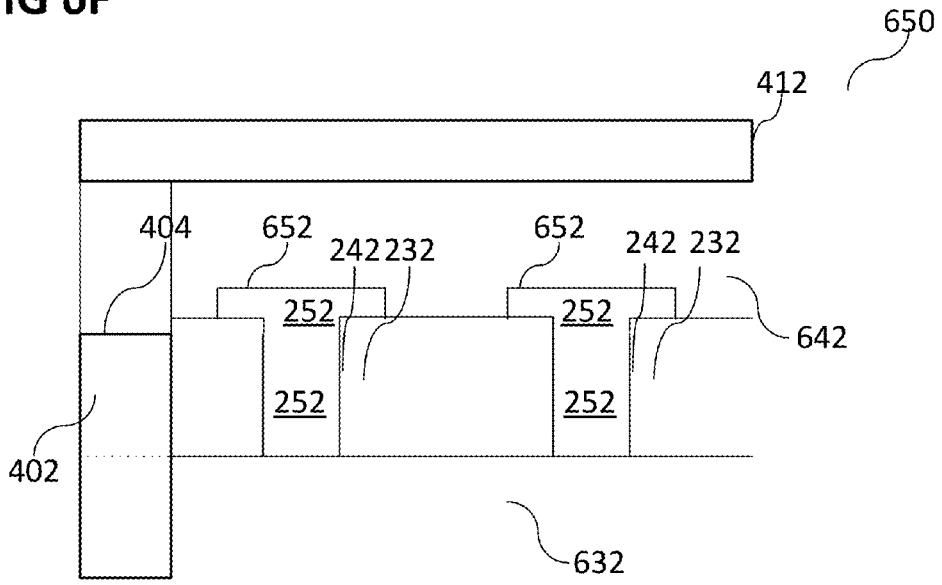

Finally, as shown in FIG. 6F illustrating a sixth cross-sectional view 650 representing a sixth process stage, the lining oxide layer 232 and the further lining oxide layer 612 may be removed so that the grid with the plurality of grid elements including respective T-structures 652 is formed and thereby exposed.

FIGS. 7A to 7F show cross-sectional views of a process of manufacturing of a MEMS device having a monolithically integrated particle filter in accordance with various embodiments.

In various embodiments, the grid may be formed illustratively by two grids stacked above one another with one or more second grid portions being free hanging between two first grid portions being made from a plurality of grid layers, the second grid portions only being formed from exactly one grid layer, namely e.g. the "upper" grid layer. In other words, the grid may include two layers, wherein one layer may serve as a stabilization element and one layer may serve as an electrode. However, the grid also in accordance with these embodiments functions as a particle filter. Providing these second grid portions may provide an additional electrical capacity of the electrode, for example, without a substantial increase of the flow resistance caused by the grid.

Figure 7A:
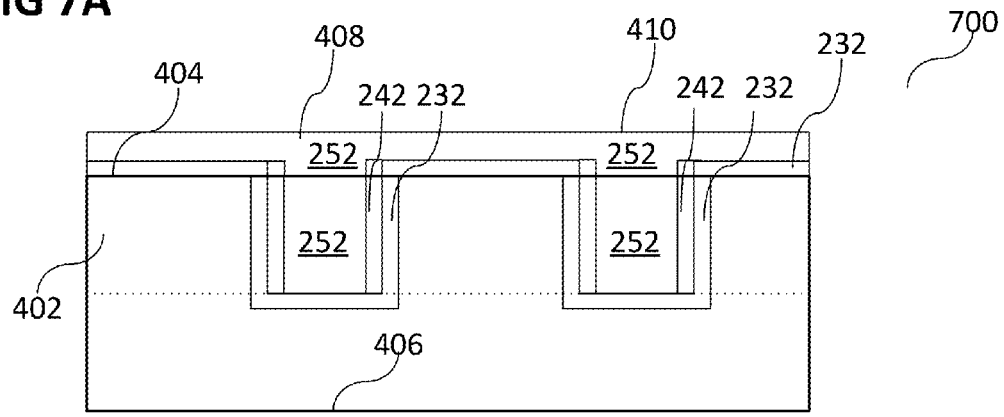
FIGS. 7A to 7F show cross-sectional views of a process of manufacturing of a MEMS device having a monolithically integrated particle filter in accordance with various embodiments.

FIG. 7A shows in a first cross-sectional view 700 a first process stage, which is similar to the process stage of FIG. 2D. As shown in FIG. 7A, the lining oxide layer 232 still covers the entire surface of the substrate 402. Furthermore, also the polysilicon 252 has not been removed yet from the substrate 402 and thus covers the entire surface of the lining oxide layer 232. The thickness of the polysilicon 252 over the horizontal surface of the lining oxide layer 232 may be in the range from about 0.5 μm to about 5 μm, for example in the range from about 1 μm to about 2 μm. Thus, in various embodiments, the thickness of the polysilicon 252 over the upper surface 404 of the substrate 402 and the lining oxide layer 232 may be rather thin, so that the thus provided layer is a thin layer which may be provided to using a planar process which may be implemented by a conformal deposition of the polysilicon 252. This horizontal leg of the T-structure may serve as an electrode. Thus, in various embodiments, in which the grid is formed by two or more grid layers or grid portions, the stabilizing portion such as the horizontal leg of the T-structure, may be formed of an electrically insulating material such as e.g. an oxide (e.g. silicon oxide) or a nitride (e.g. silicon nitride) or silicon. Furthermore, the horizontal leg of the T-structure may have a radius in the range from about 0.5 μm to about 4 μm, e.g. in the range from about 1 μm to about 2 μm. In various embodiments, the horizontal leg of the T-structure may have a dimension or size sufficiently large to provide a sufficient electrical capacity so that it can function as an electrode, e.g. as a backplate electrode of the MEMS device, e.g. of the microphone or the loudspeaker. Furthermore, in various embodiments, the material forming the horizontal leg of the T-structure may be the same as or may be different from the material of the vertical leg of the T-structure. Illustratively, in various embodiments, the grid having a plurality of grids or grid layers, e.g. having such a T-structure as described above, may provide a double functionality, i.e. it may function as an electrode (e.g. as a backplate) of the MEMS device, and at the same time it may function as a particle filter with e.g. the vertical leg of the T-structure serving as the main stabilizing element and thus functioning as a particle filter. Moreover, in various embodiments, the two grids (e.g. the horizontal leg and the vertical leg of the T-structure) of the total grid may be electrically decoupled form each other. It should be noted that it is not necessary that the "upper" grid layer laterally extends over the "lower" grid layer supporting the "upper" grid layer. The "upper" grid layer may have the same lateral extension as the "lower" grid layer or even may be smaller.

The shape of the respective grid elements (in top view) (also of the other embodiments) may in general be arbitrary, e.g. it may be round (e.g. circular or elliptical), it may have a triangular shape or a rectangular (e.g. quadratic) shape or a regular or irregular shape having four or even more corners.

Furthermore, as will be described in more detail below, a first mesh width of the "lower" grid formed e.g. by the "lower" grid layer may be the same as or may be different from a second mesh width of the "upper" grid formed e.g. by the "upper" grid layer. In various embodiments, the "lower" grid may have larger mesh width than the "upper" grid (in other words, the first mesh width may be larger than the second mesh width).

Figure 7B:
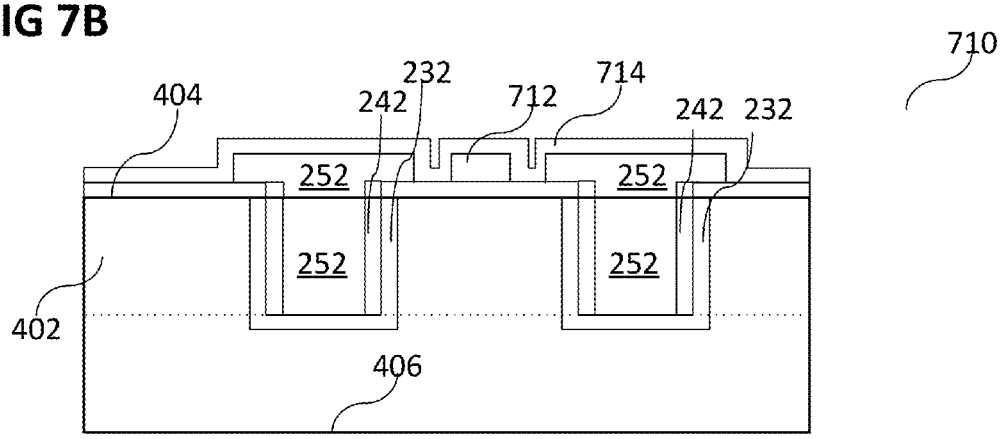

Then, as shown in a second cross-sectional view 710 in FIG. 7B (which represents a second process stage), the polysilicon 252 may be patterned to form a plurality of T-shape grid structures and one or more intermediate free hanging polysilicon elements 712 between two respective T-shape grid structures, for example. Then, a further lining oxide layer 712 (e.g. made of silicon oxide), which may be made from the same or a different material than the lining oxide layer 232, may be deposited over the entire upper surface of the patterned structure.

Figure 7C:
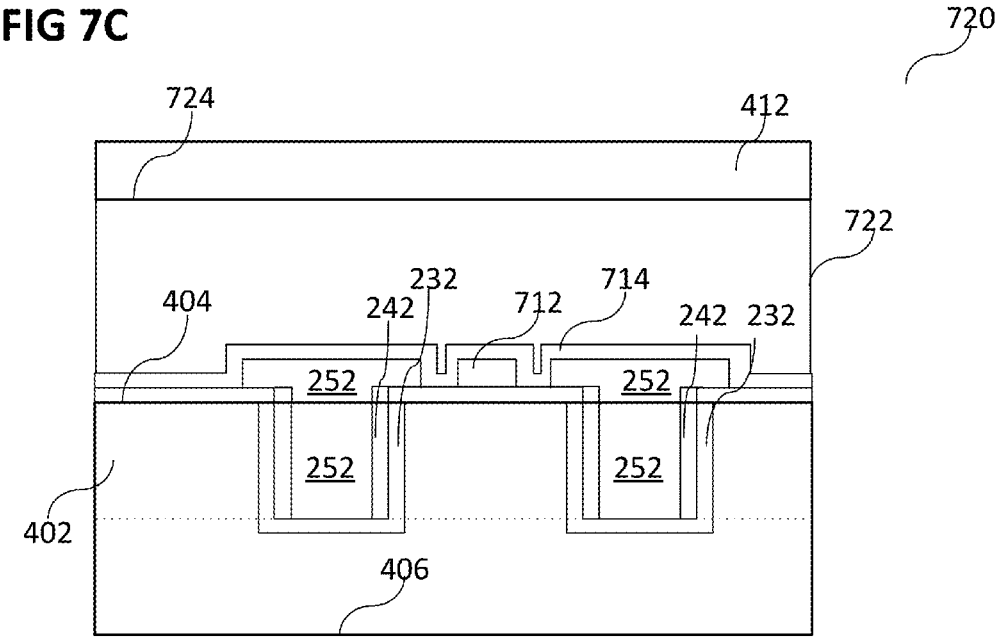

Furthermore, as shown in a third cross-sectional view 720 in FIG. 7C representing a third process stage, an oxide layer 722 may be deposited over the further lining oxide layer 714. The oxide layer 722 may have a layer thickness in the range from about 0.5 μm to about 4 μm, for example in the range from about 1 μm to about 2 μm. Then, the MEMS structure 412, which may be similar to the MEMS structure 308 as shown in FIG. 3A or to the MEMS chip 108 as shown in FIG. 1A, may be formed on a front side 724 surface of the oxide layer 722 and may thus be in physical contact with the front side 724 surface of the oxide layer 722.

Then, the cavity 632 from the rear side may be opened stopping on the oxide layer 634. Illustratively, the oxide layers 634, 714, 722 may be etched selectively against the polysilicon 525, 242 to release the MEMS structure 412.

Figure 7D:
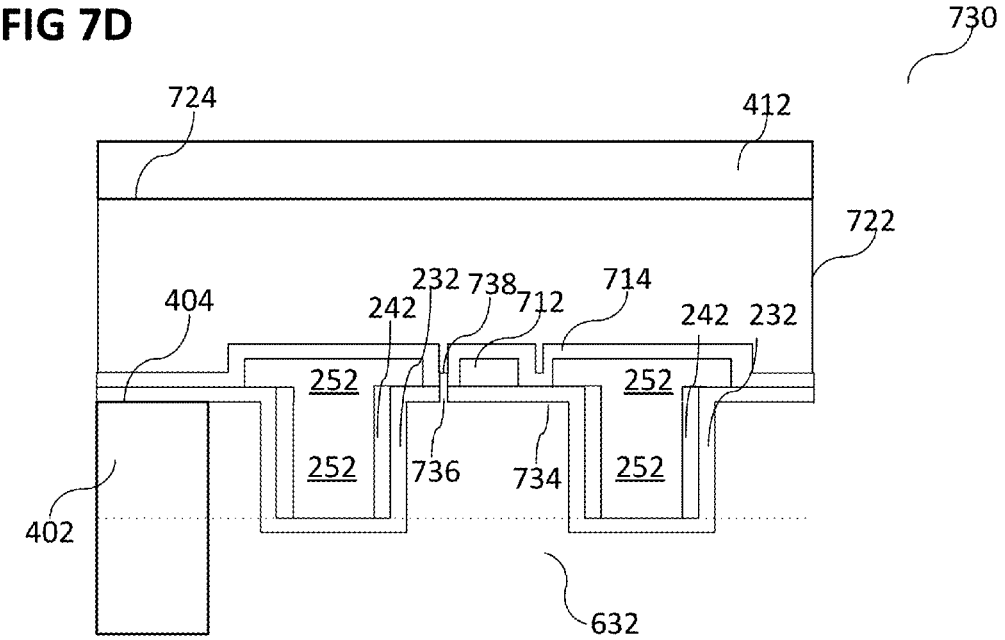

As an alternative process, as shown with reference to FIG. 7D illustrating a fourth cross-sectional view 730 representing a fourth process stage, a first rear side trench etching process (in other words a first etch process applied to the rear side 406 of the substrate 402) is applied to the rear side 406 of the substrate 402 to form one or more first cavity portions 732. With the first rear side trench etching process, the bottom surface 734 of the lining oxide layer 232 may be exposed. Then, an opening 736 may be formed through the lining oxide layer 232 and the further lining oxide layer 714 may be etched between two respective T-structures. Thus, a portion 738 of a rear surface of the oxide layer 722 may be exposed. Illustratively, the lining oxide layer 232 and the further lining oxide layer 714 protect the polysilicon 252, 712 from being removed during the first rear side trench etching process and the etch process used for forming the opening 736. The exposed portion 738 of the rear surface of the oxide layer 722 may serve as a starting point for a second rear side trench etching process as will be described in more detail below.

Figure 7E:
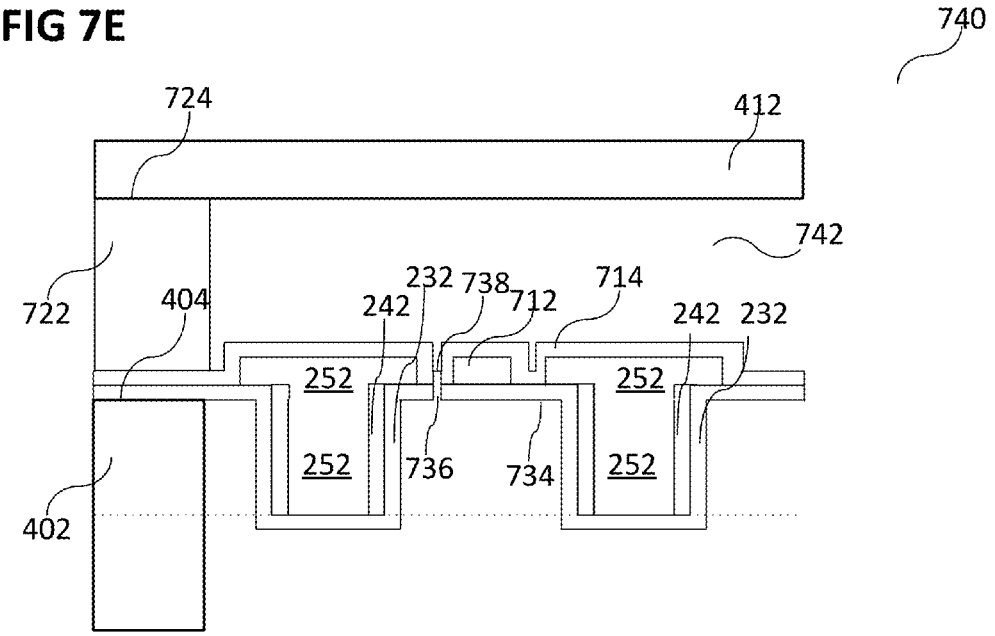

With reference to FIG. 7E illustrating a fifth cross-sectional view 740 representing a fifth process stage, a portion of the oxide layer 722 may be removed using the second rear side trench etching process through the opening 736 to expose a portion of the MEMS structure 412, which was in physical contact with the oxide layer 722. Thus, one or more second cavity portions 742 above the further lining oxide layer 714 may be formed.

Figure 7F:
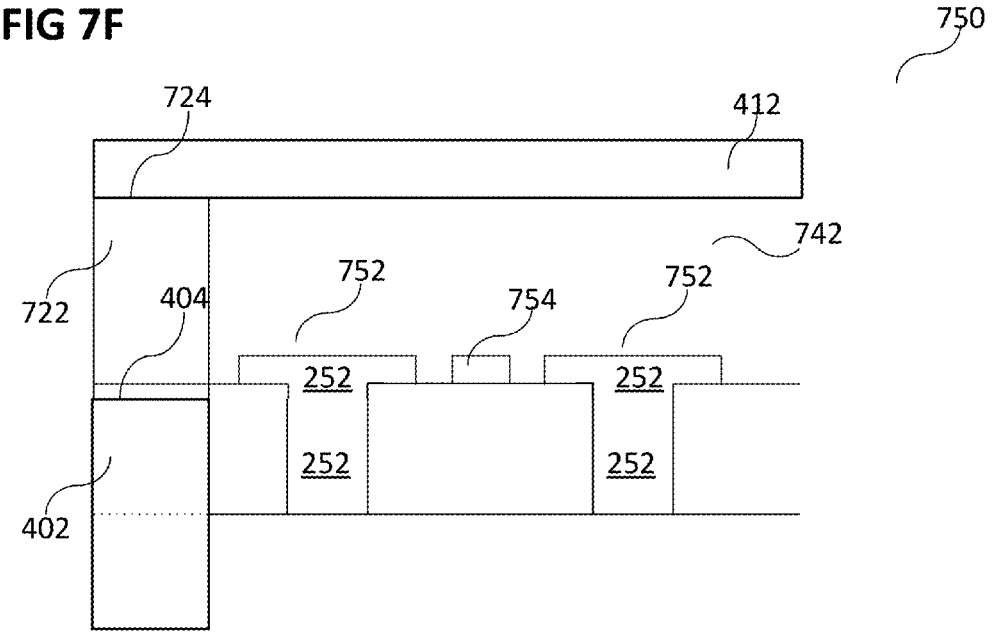

Finally, as shown in FIG. 7F illustrating a sixth cross-sectional view 750 representing a sixth process stage, the lining oxide layer 232 and the further lining oxide layer 714 may be removed so that the grid with the plurality of grid elements including respective T-structures 752 is formed. Furthermore, one or more free hanging electrode structures 754 are also formed. In various embodiments, as described above, the grid may include a plurality of grids which may have the same or different mesh widths. In various embodiments, the "lower" grid may have larger mesh width than the "upper" grid (in other words, the first mesh width may be larger than the second mesh width). By way of example, the first mesh width may be at least twice as large as the second mesh width.

Figure 8:
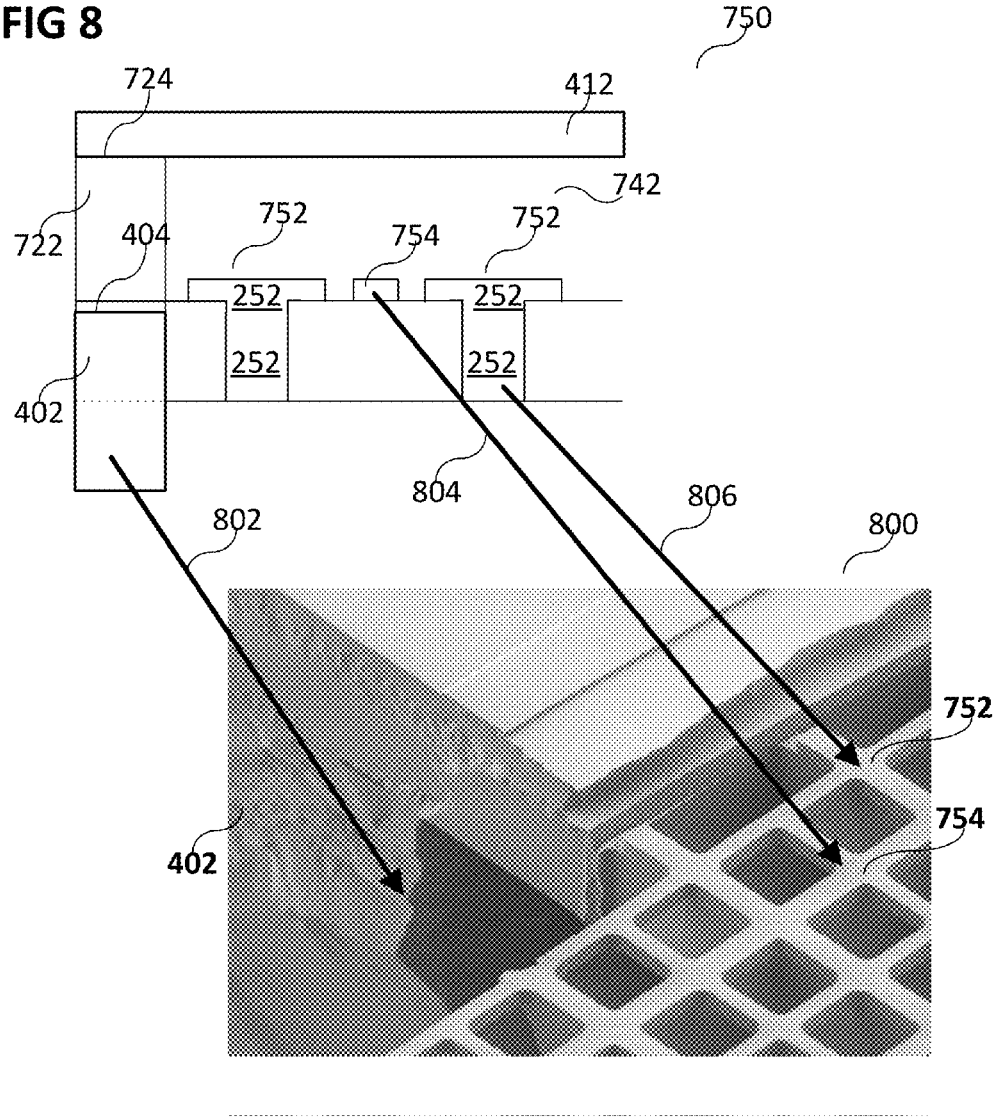
FIG. 8 shows the illustration of FIG. 7F and a photo of a manufactured silicon grid after a removal of the MEMS device for illustration purposes.

FIG. 8 shows the illustration of FIG. 7F and a photo 800 of a manufactured silicon grid after a removal of the MEMS device for illustration purposes. By way of example, the respective assignments of the substrate 402, the T-structures 752 and the free hanging electrode structure 754 are shown by arrows 802, 804, 806, respectively.

Figure 9:
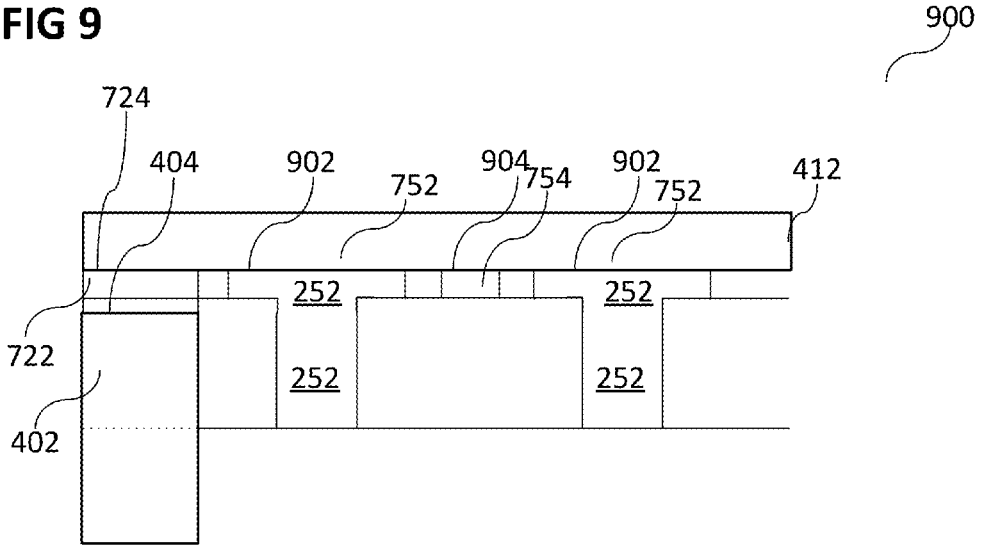
FIG. 9 shows a cross-sectional view of a MEMS device having a monolithically integrated particle filter in accordance with various embodiments.

FIG. 9 shows a cross-sectional view 900 of a MEMS device having a monolithically integrated particle filter in accordance with various embodiments. The MEMS device as shown in FIG. 9 is similar to the MEMS device as shown in FIG. 7F with the difference that the upper surface 902 of the T-structures 754 as well as the upper surface 904 of the free hanging electrode structure(s) 754 are in direct physical contact with the lower surface of the MEMS structure 412.

Figure 10A:
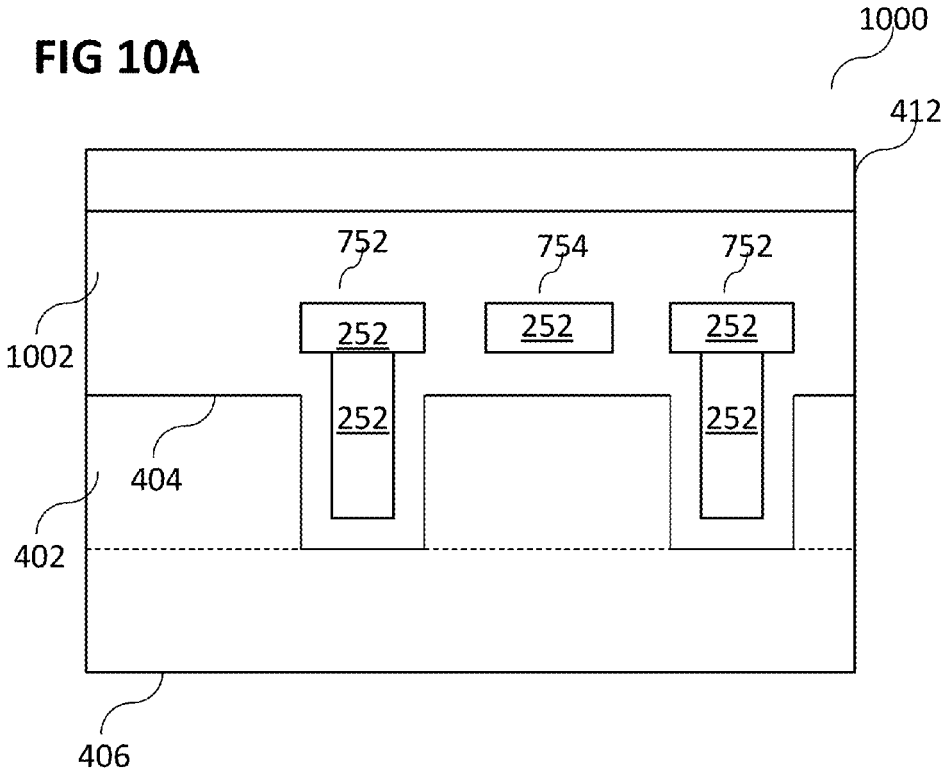
FIGS. 10A and 10B show cross-sectional views of a process of manufacturing of a MEMS device having a monolithically integrated particle filter in accordance with various embodiments.
Figure 10B:
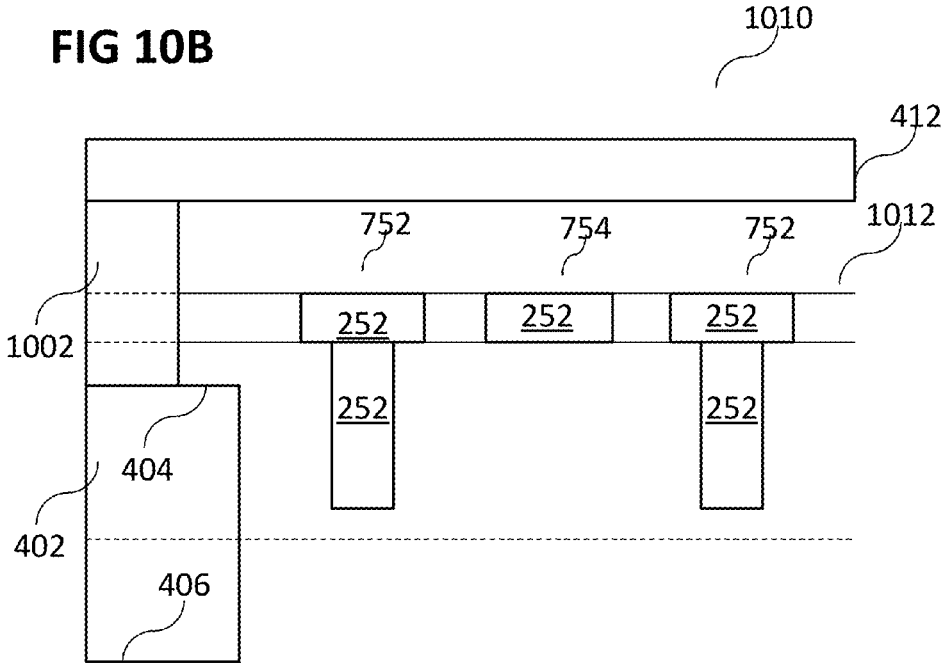

FIGS. 10A and 10B show cross-sectional views of a process of manufacturing of a MEMS device having a monolithically integrated particle filter in accordance with various embodiments. The MEMS device as shown in FIG. 10B is a similar to the MEMS device as shown in FIG. 7F with the difference that the MEMS device as shown in FIG. 10B includes a spacer layer 1002 made e.g. from an electrically insulating material such as an oxide (e.g. silicon oxide) or a nitride (e.g. silicon nitride). Thus, the material of the spacer layer 1002 may be different from the material of the oxide layer 722.

As shown in FIG. 10A illustrating a first cross-sectional view 1000 representing a first process stage, the spacer layer 1002 is provided over the substrate 402 and completely surrounds (in other words encapsulates) the T-structures 752 and the free hanging electrode structure(s) 754. Furthermore, as shown in FIG. 10B illustrating a second cross-sectional view 1010 representing a second process stage, the substrate 402 and the spacer layer 1002 may be partially removed, e.g. using a rear side trench etching process (in other words an etch process applied to the rear side 406 of the substrate 402). Thus, the grid 1012 is anchored in the substrate 402 (in more detail, some of the "lower" grid portions (which may also be referred to as trenches) and partially exposed from the substrate material as well as from the material of the spacer layer 1002, to thereby also partially expose a portion of the MEMS structure 412. Thus, in various embodiments, a sound channel with a monolithically integrated particle filter formed by a portion of the grid 1012 is provided.

Figure 11A:
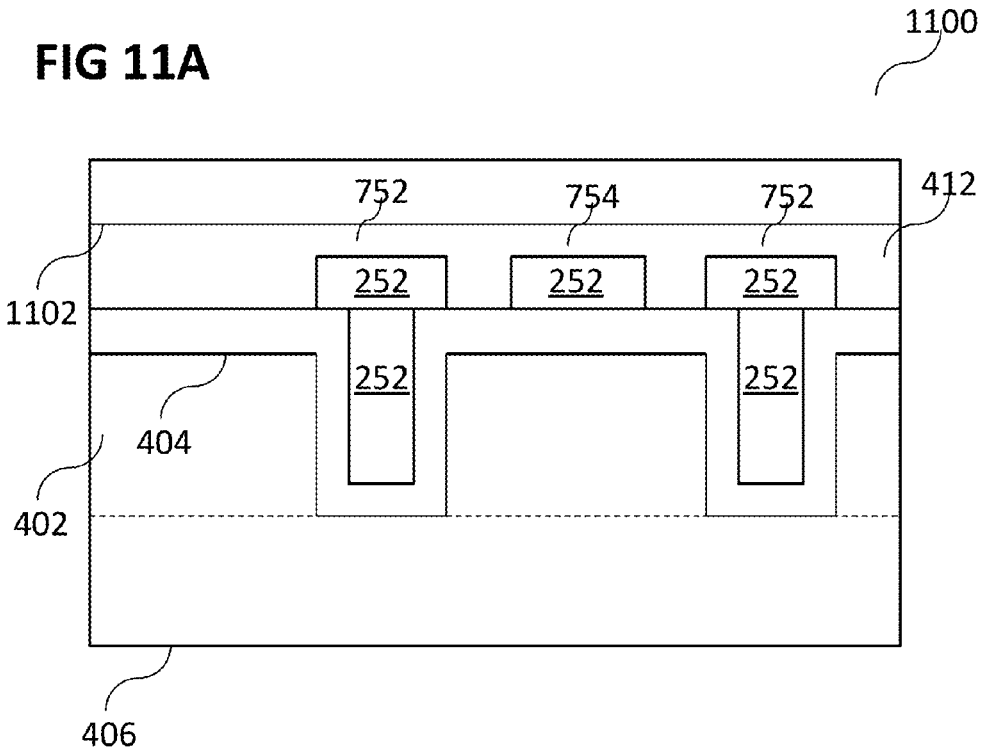
FIGS. 11A and 11B show cross-sectional views of a process of manufacturing of a MEMS device having a monolithically integrated particle filter in accordance with various embodiments.
Figure 11B:
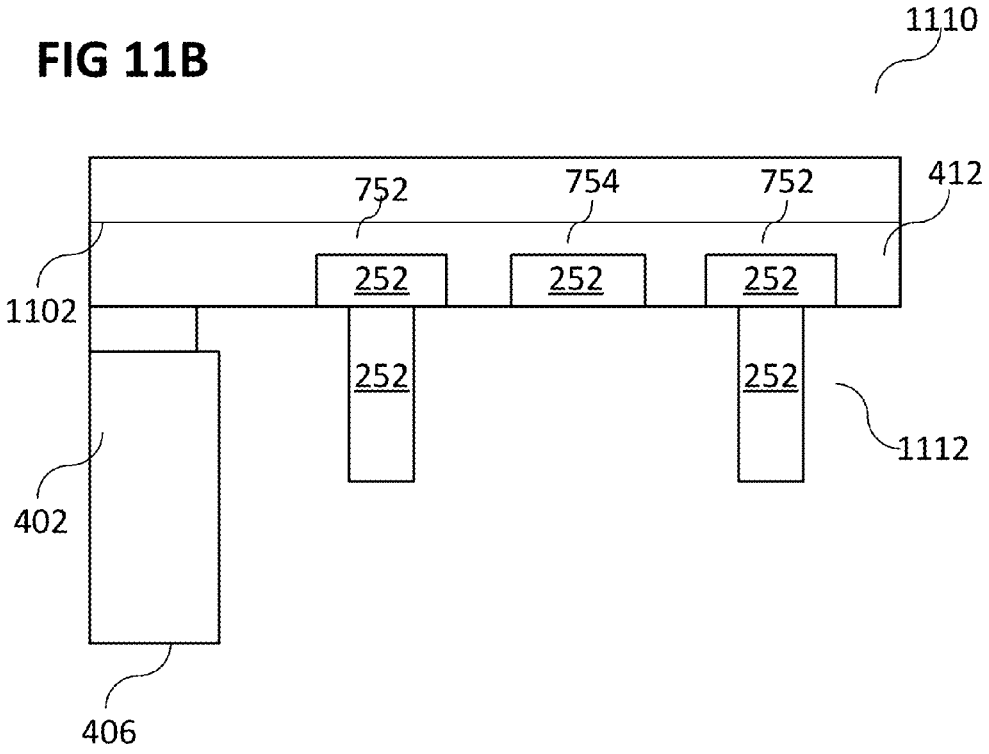

FIGS. 11A and 11B show cross-sectional views of a process of manufacturing of a MEMS device having a monolithically integrated particle filter in accordance with various embodiments. The MEMS device as shown in FIG. 11B is similar to the MEMS device as shown in FIG. 10B with the difference that the MEMS device as shown in FIG. 11B includes a bottom backplate (e.g. of a microphone or a loudspeaker) or a so-called double backplate configuration (e.g. of a microphone or a loudspeaker). The bottom backplate of the double backplate may include an electrically insulating layer 1102 such as an oxide (e.g. silicon oxide) or a nitride (e.g. silicon nitride).

As shown in FIG. 11A illustrating a first cross-sectional view 1100 representing a first process stage, wherein the electrically insulating layer 1102 is provided over the substrate 402 and completely surrounds (in other words encapsulates) the T-structures 752 and the free hanging electrode structure(s) 754. Furthermore, as shown in FIG. 11B illustrating a second cross-sectional view 1110 representing a second process stage, the substrate 402 and the electrically insulating layer 1102, which is a part of the MEMS structure 412, may be partially removed, e.g. using a rear side trench etching process (in other words an etch process applied to the rear side 406 of the substrate 402). In various embodiments, the grid 1112 may be fixed to the electrically insulating layer 1102 (in more detail, some of the "upper" grid portions (which may also be referred to as T-elements, for example). The "lower" grid portions may be exposed from the substrate material as well as from the material of the electrically insulating layer 1102, to thereby also partially expose a portion of the MEMS structure 412. Thus, in various embodiments, a sound channel with a monolithically integrated particle filter formed by a portion of the grid 1112 is provided. Illustratively, in various embodiments, the grid 1112 may be mounted at the MEMS structure 412.

Figure 12A:
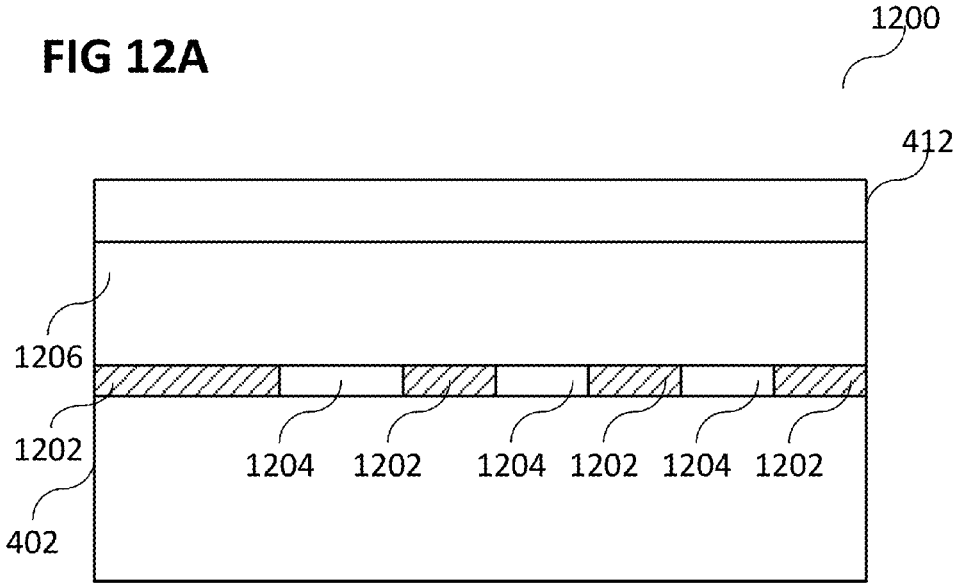
FIGS. 12A and 12B show cross-sectional views of a process of manufacturing of a MEMS device having a monolithically integrated particle filter in accordance with various embodiments.
Figure 12B:
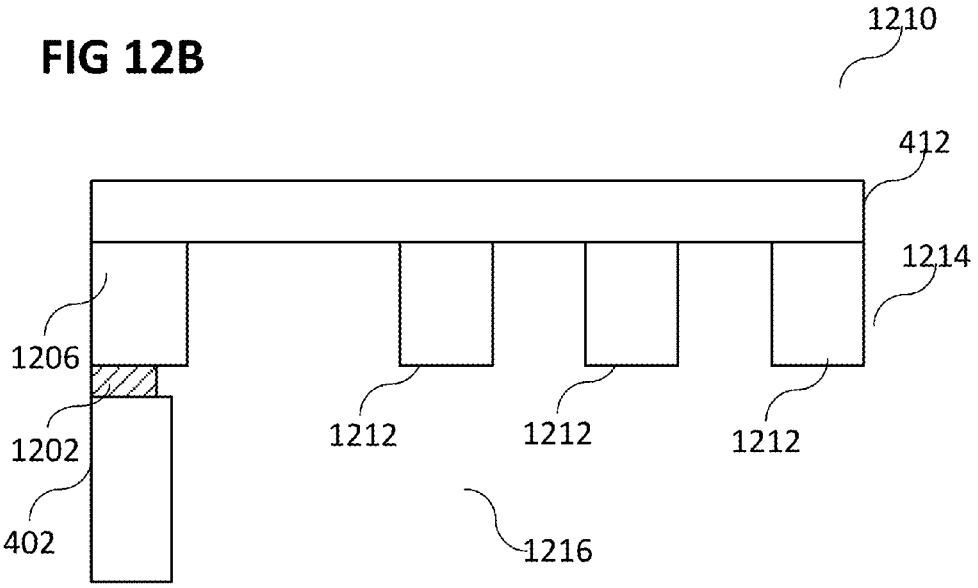

FIGS. 12A and 12B show cross-sectional views of a process of manufacturing of a MEMS device having a monolithically integrated particle filter in accordance with various embodiments. The MEMS device as shown in FIG. 12B is similar to the MEMS device as shown in FIG. 4B with the difference that the MEMS device as shown in FIG. 12B is formed using a buried hard mask 1202 being implemented by a patterned insulating layer such as a patterned oxide layer (e.g. a patterned silicon oxide layer) or a patterned nitride layer (e.g. a patterned silicon nitride layer).

As shown in FIG. 12A illustrating a first cross-sectional view 1200 representing a first process stage, the MEMS device may include the substrate 402 and a further substrate 1206 with a buried hard mask layer 1202 (e.g. a patterned insulating layer as described above) being sandwiched between the substrate 402 and the further substrate 1206 (the further substrate 1206 may be made of the same material as the substrate 402; by way of example, the further substrate 1206 and the substrate 402 may be made of a semiconductor material, for example of silicon). Through openings provided in the buried hard mask layer 1202 may be completely filled with substrate material 1204, that is for example with the same material that is provided for the substrate 402 and/or the further substrate 1206, i.e. for example silicon. In various embodiments, the through openings of the buried hard mask layer 1202 define the structure of the grid portions, which will form the grid.

Furthermore, as shown in FIG. 12B illustrating a second cross-sectional view 1210 representing a second process stage, the substrate 402, the material 1204 in the through openings of the buried hard mask layer 1202 and the material of the further substrate 1206 may be partially removed, e.g. using a rear side trench etching process (in other words an etch process applied to the rear side 406 of the substrate 402). In this way, the individual grid portions 1212 are formed, which are forming the grid 1214. Then, the buried hard mask layer 1202 will substantially be removed except for a portion outside the cavity 1216 previously formed between the remaining substrate 402 and the remaining further substrate 1206.

Figure 13A:
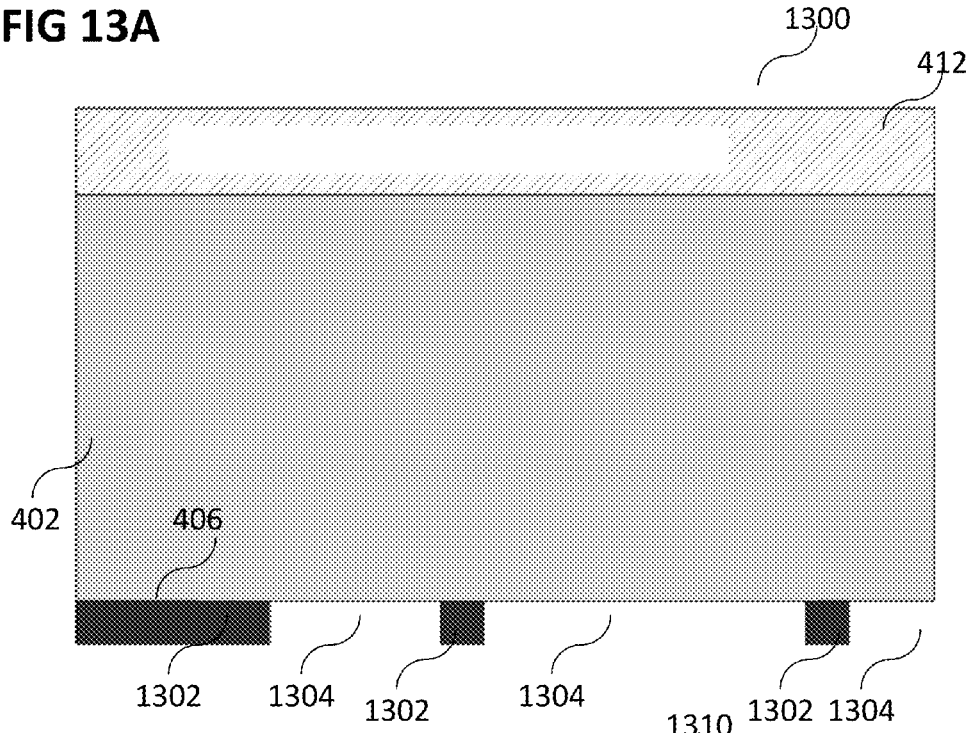
FIGS. 13A and 13B show cross-sectional views of a process of manufacturing of a MEMS device having a monolithically integrated particle filter in accordance with various embodiments.
Figure 13B:
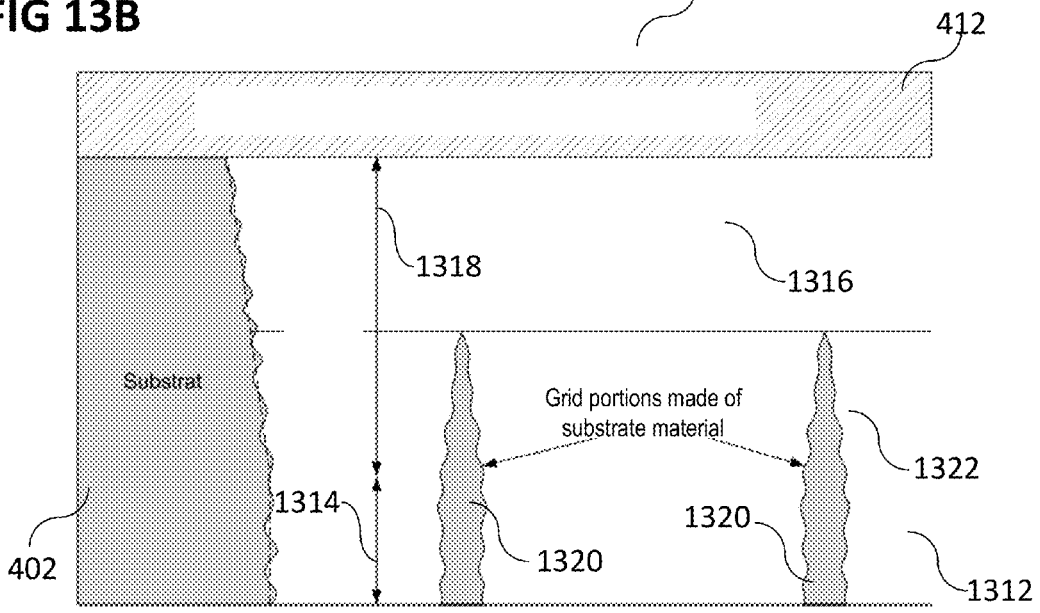

As shown in FIG. 13A illustrating a first cross-sectional view 1300 representing a first process stage, the MEMS device may include the substrate 402 and a hard mask layer 1302 (e.g. a patterned insulating layer such as an oxide (for example silicon oxide) or a nitride (for example silicon nitride)) being arranged below the lower surface 406 of the substrate 402. Through openings 1304 provided in the hard mask layer 1302 may define the structure of the grid portions, which will form the grid, as will be described further below. Furthermore, as shown in FIG. 13B illustrating a second cross-sectional view 1310 representing a second process stage, using the hard mask layer 1302 as an etching mask, a first rear side trench etching process may be applied to the rear side 406 of the substrate 402. The first rear side trench etching process may be a substantially vertical etching process, in other words, an anisotropic etching process. The first rear side trench etching process may be carried out until a first cavity 1312 having a first depth (symbolized in FIG. 13B by a first double arrow 1314) and will then be stopped. Then, a second rear side trench etching process may be applied, may in this second trench etching process may be a retrograde etching process which will result in inclined grid portions 1320 of the formed grid 1322. The second trench etching process may be continued until the lower surface of the MEMS structure 412 will partially be exposed. Thus, a second cavity 1316 will be formed. The depth of the second etching process is designated by a second double arrow 1318. It is to be noted that a portion of the second cavity 1316 is completely free from any grid portion 1320, so that the grid 1322 is only anchored in the substrate 402 and has no direct physical contact with the MEMS structure 412.

Figure 14A:
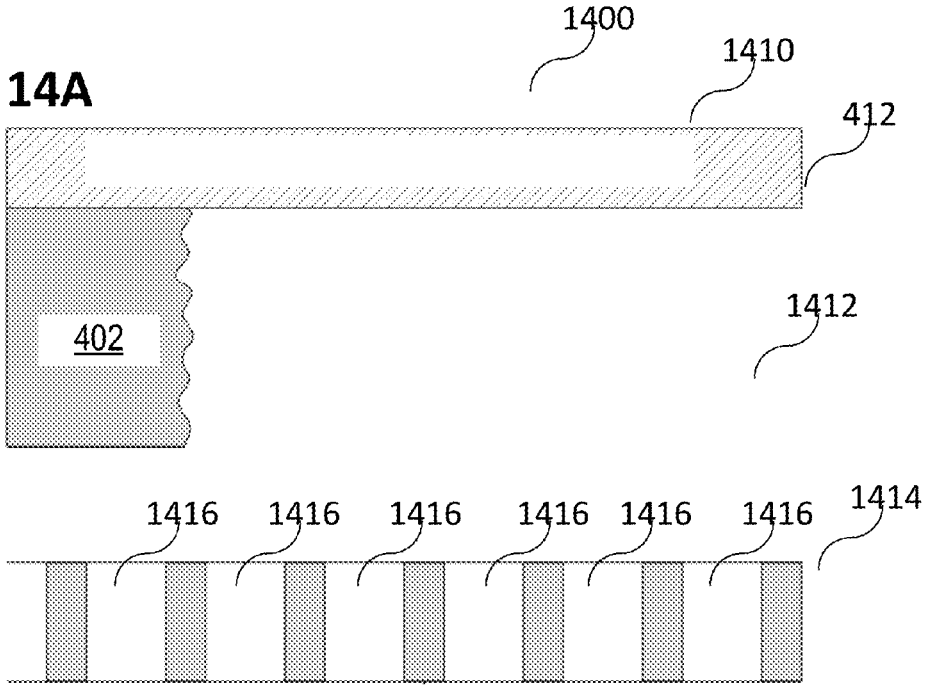
FIGS. 14A and 14B show cross-sectional views of a process of manufacturing of a MEMS device having a monolithically integrated particle filter in accordance with various embodiments.
Figure 14B:
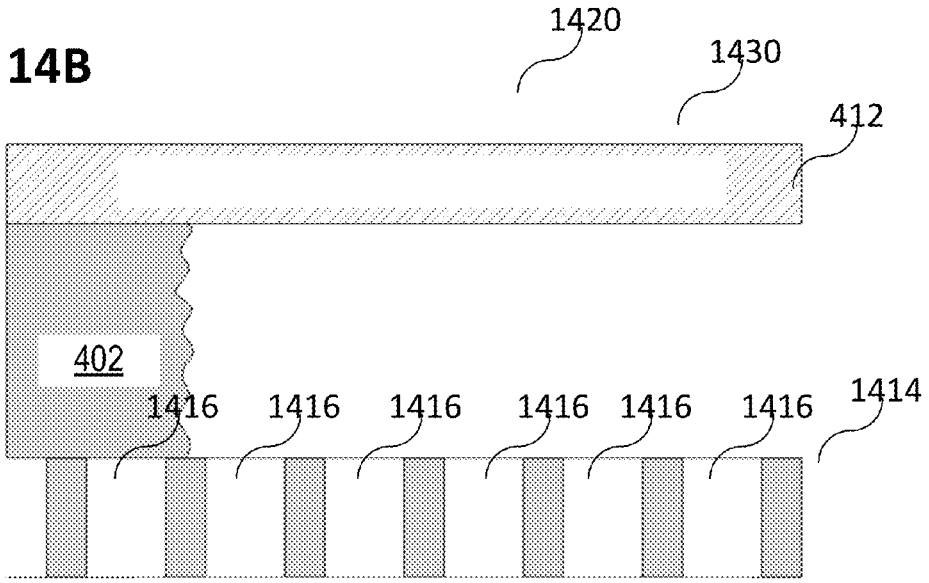

FIGS. 14A and 14B show cross-sectional views of a process of manufacturing of a MEMS device having a monolithically integrated particle filter in accordance with various embodiments.

Illustratively, the embodiments as shown in FIGS. 14A and 14B provide a grid by using a direct wafer bonding process to bond a pre-manufactured grid (which may also be referred to as a grid wafer), which may be made of a substrate material such as a semiconductor material, for example silicon, to a substrate, into which a cavity (which may for example serve as a sound channel) has already been asked, for example using a rear side trench etching process.

As shown in FIG. 14A illustrating a first cross-sectional view 1400 representing a first process stage, the MEMS device may include the substrate 402 and MEMS structure 412. The structure 1410 as shown in FIG. 14A is similar to the structure as shown in FIG. 3B. Furthermore, structure 1410 further includes a cavity 1412 after having applied a rear side trench etching process. In various embodiments, it may be provided to remove sacrificial layers only after having carried out a wafer bonding to the grid wafer to allow an easier handling of the MEMS wafer. Furthermore, a grid wafer 1414 is shown which at the first processing stage is still separate from the structure 1410. The grid wafer 1414 may include the same material as the substrate 402, for example a semiconductor material such a silicon. Furthermore, the grid wafer 1414 includes a plurality of through openings 1416 which extend through the entire grid wafer in its thickness direction.

As shown in FIG. 14B illustrating a second cross-sectional view 1420 representing a second process stage, the grid wafer 1414 may then be directly bonded (for example by a direct wafer bond process) to the structure 1410, more accurately to the lower surface 406 of the substrate 402. In other words, the grid wafer 1414 will be fixed to the substrate 402 and the grid covers the cavity 1412, to thereby form a particle filter for the MEMS structure 412. Illustratively, the structure 1410 and the grid wafer 1414 function as a monolithic substrate 1430.

Then, the as such standard release etching may be applied to e.g. free the MEMS portion 412 from sacrificial layers and additional conventional manufacturing processes may be carried out such as for example one or more wafer test processes, a singulation process (e.g. a sawin process), etc.

Figure 15:
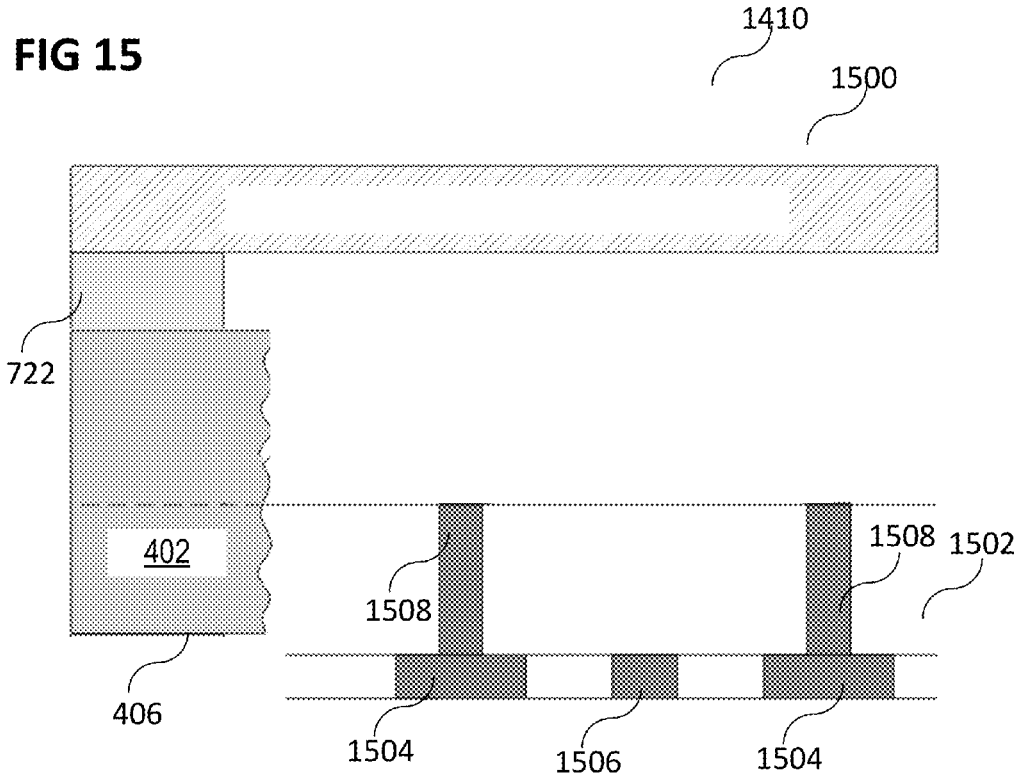
FIG. 15 shows a MEMS device having a monolithically integrated particle filter in accordance with various embodiments.

FIG. 15 shows a MEMS device 1500 having a monolithically integrated particle filter 1502 in accordance with various embodiments. The MEMS device 1500 is a similar to the previous MEMS device as shown in FIG. 7F, but the particle filter 1502 of the MEMS device 1500 is arranged in an inverse manner, i.e. the T-structures 1504 and the free hanging element(s) 1506 form the "lower" grid layer of the grid and the "trench" portions 1508 form the "upper" grid layer of the grid. This "inverse" arrangement may be applied to any of the previously described embodiments. Illustratively, the "T" s are facing the outside of the MEMS device 1500. This kind of structure may form a hydrophobic MEMS device.

It is to be noted that the surface of portions of the grid or the entire surface of the grid may be coated with a coating layer, which may provide hydrophobic or oleophobic characteristics.

Illustratively, in various embodiments, instead of mounting a particle filter e.g. for each single microphone in the sound channel in front of the printed circuit board (in general for each MEMS device in the cavity) only during the manufacturing of the terminal device, it is proposed to directly integrate this particle filter into the MEMS chip.

Example 1 is a micro-electro-mechanical system device. The micro-electro-mechanical system device may include a carrier; a particle filter structure coupled to the carrier, the particle filter structure including a grid. The grid includes a plurality of grid elements, each grid element having at least one through hole; and a micro-electro-mechanical system structure disposed on a side of the particle filter structure opposite the carrier. A height of the plurality of grid elements is greater than a width of the corresponding grid elements.

In the example 2, the subject matter of example 1 may optionally include that at least a portion of the grid element has a width in the range from about 0.3 μm to about 1 μm.

In the example 3, the subject matter of example 1 or 2 may optionally include that at least a portion of the grid element has a height in the range from about 3 μm to about 20 μm.

In the example 4, the subject matter of any one of examples 1 to 3 may optionally include that the grid includes a first grid layer and a second grid layer disposed over the first grid layer. The micro-electro-mechanical system structure may be disposed on the same side as the second grid layer with respect to the first grid layer. The second grid layer may have a greater width than the first grid layer.

In the example 5, the subject matter of example 4 may optionally include that the second grid layer is electrically conductive.

In the example 6, the subject matter of example 4 or 5 may optionally include that the second grid layer has a smaller mesh width than the first grid layer.

In the example 7, the subject matter of any one of examples 1 to 6 may optionally include that the micro-electro-mechanical system structure is configured as a microphone or a loudspeaker.

In the example 8, the subject matter of example 7 may optionally include that the particle filter structure forms at least a portion of a backplate of the microphone or a loudspeaker.

In the example 9, the subject matter of any one of examples 4 to 8 may optionally include that the grid includes silicon.

In the example 10, the subject matter of any one of examples 1 to 9 may optionally include that the particle filter structure is at least partially coated with a hydrophobic layer.

In the example 11, the subject matter of any one of examples 1 to 10 may optionally include that the particle filter structure is at least partially coated with a oleophobic layer.

Example 12 is a micro-electro-mechanical system device. The micro-electro-mechanical system device may include a first substrate and a second substrate bonded to the first substrate. The second substrate includes a particle filter structure and the particle filter structure includes a grid. The grid includes a plurality of grid elements, each grid element including at least one through hole. The micro-electro-mechanical system device may further include a micro-electro-mechanical system structure disposed over the first substrate opposite the second substrate. A height of the plurality of grid elements is greater than a width of the corresponding grid elements.

In the example 12, the subject matter of example 1 may optionally include that

In the example 13, the subject matter of example 12 may optionally include that at least a portion of the grid element has a width in the range from about 0.3 μm to about 1 μm.

In the example 14, the subject matter of example 12 or 13 may optionally include that at least a portion of the grid element has a height in the range from about 3 μm to about 20 μm.

In the example 15, the subject matter of any one of examples 12 to 14 may optionally include that the grid includes a first grid layer and a second grid layer disposed over the first grid layer. The micro-electro-mechanical system structure is disposed on the same side as the second grid layer with respect to the first grid layer. The second grid layer has a greater width than the first grid layer.

In the example 16, the subject matter of example 15 may optionally include that the second grid layer has a smaller mesh width than the first grid layer.

In the example 17, the subject matter of example 15 may optionally include that the second grid layer has a larger mesh width than the first grid layer.

In the example 18, the subject matter of any one of examples 12 to 17 may optionally include that the micro-electro-mechanical system structure is configured as a microphone or a loudspeaker.

In the example 19, the subject matter of example 18 may optionally include that the particle filter structure forms at least a portion of a backplate of the microphone or a loudspeaker.

In the example 20, the subject matter of any one of examples 12 to 19 may optionally include that the grid includes silicon.

In the example 21, the subject matter of any one of examples 12 to 20 may optionally include that the particle filter structure is at least partially coated with a hydrophobic layer.

In the example 22, the subject matter of any one of examples 12 to 20 may optionally include that the particle filter structure is at least partially coated with a oleophobic layer.

Example 23 is a micro-electro-mechanical system device. The micro-electro-mechanical system device may include a carrier; a particle filter structure coupled to the carrier, the particle filter structure including a silicon grid. The silicon grid includes a plurality of grid elements, each grid element having at least one through hole. The micro-electro-mechanical system device may further include a micro-electro-mechanical system structure disposed over the particle filter structure. The micro-electro-mechanical system structure includes a plurality of electrodes and a membrane coupled to the plurality of electrodes. At least a portion of the grid element has a width in the range from about 0.3 μm to about 1 μm. At least a portion of the grid element has a height in the range from about 3 μm to about 20 μm.

In the example 24, the subject matter of example 23 may optionally include that the grid includes a first grid layer and a second grid layer disposed over the first grid layer. The micro-electro-mechanical system structure is disposed on the same side as the second grid layer with respect to the first grid layer. The second grid layer has a greater width than the first grid layer.

In the example 25, the subject matter of example 24 may optionally include that the first grid layer has a width in the range from about 0.3 μm to about 1 μm.

In the example 26, the subject matter of example 24 or 25 may optionally include that the second grid layer has a width in the range from about 1 μm to about 3 μm.

In the example 27, the subject matter of any one of examples 24 to 26 may optionally include that the second grid layer has a height in the range from about 0.5 μm to about 5 μm.

In the example 28, the subject matter of any one of examples 23 to 27 may optionally include that at least a portion of the grid element has a height that is greater than its width by a factor of at least 2.

In the example 29, the subject matter of any one of examples 23 to 28 may optionally include that the micro-electro-mechanical system structure is configured as a microphone or a loudspeaker. The particle filter structure forms at least a portion of a backplate of the microphone or a loudspeaker.

In the example 30, the subject matter of any one of examples 23 to 29 may optionally include that the grid includes polysilicon.

In the example 31, the subject matter of any one of examples 23 to 30 may optionally include that the particle filter structure is at least partially coated with a hydrophobic layer.

In the example 32, the subject matter of any one of examples 23 to 30 may optionally include that the particle filter structure is at least partially coated with a oleophobic layer.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A micro-electro-mechanical system device, comprising:

a carrier having a front side and a rear side opposite the front side, the carrier comprising a cavity;

a particle filter structure coupled to the carrier and disposed in the cavity between the front side and the rear side of the carrier, the particle filter structure comprising a grid, wherein the grid comprises a plurality of grid elements, each grid element comprising at least one through hole; and a micro-electro-mechanical system structure disposed on the front side of the carrier, wherein a side of the micro-electro-mechanical system structure facing the carrier is at least partially exposed by the cavity;

wherein a height of the plurality of grid elements is greater than a width of the corresponding grid elements.

2. The micro-electro-mechanical system device of claim 1, wherein at least a portion of the grid element has a width in the range from about 0.3 μm to about 2 μm.

3. The micro-electro-mechanical system device of claim 1, wherein at least a portion of the grid element has a height in the range from about 3 μm to about 20 μm.

4. The micro-electro-mechanical system device of claim 1, wherein the grid comprises a first grid layer and a second grid layer disposed over the first grid layer;

wherein the micro-electro-mechanical system structure is disposed on the same side as the second grid layer with respect to the first grid layer;

wherein the second grid layer has a greater width than the first grid layer.

5. The micro-electro-mechanical system device of claim 4, wherein the second grid layer is electrically conductive.

6. The micro-electro-mechanical system device of claim 4, wherein the second grid layer has a smaller mesh width than the first grid layer.

7. The micro-electro-mechanical system device of claim 1, wherein the micro-electro-mechanical system structure is configured as a microphone or a loudspeaker.

8. The micro-electro-mechanical system device of claim 7, wherein the particle filter structure forms at least a portion of a backplate of the microphone or a loudspeaker.

9. The micro-electro-mechanical system device of claim 1, wherein the grid comprises silicon.

10. The micro-electro-mechanical system device of claim 1, wherein the particle filter structure is at least partially coated with a hydrophobic layer.

11. The micro-electro-mechanical system device of claim 1, wherein the particle filter structure is at least partially coated with a oleophobic layer.

12. A micro-electro-mechanical system device, comprising:

a first substrate;

a second substrate bonded to the first substrate;

wherein the second substrate comprises a particle filter structure, the particle filter structure comprising a grid, wherein the grid comprises a plurality of grid elements, each grid element comprising at least one through hole; and a micro-electro-mechanical system structure disposed over the first substrate opposite the second substrate;

wherein a height of the plurality of grid elements is greater than a width of the corresponding grid elements, and wherein the grid comprises a first grid layer and a second grid layer disposed over the first grid layer;

wherein the micro-electro-mechanical system structure is disposed on the same side as the second grid layer with respect to the first grid layer;

wherein the second grid layer has a greater width than the first grid layer.

13. The micro-electro-mechanical system device of claim 12, wherein at least a portion of the grid element has a width in the range from about 0.3 μm to about 2 μm.

14. The micro-electro-mechanical system device of claim 12, wherein at least a portion of the grid element has a height in the range from about 3 μm to about 20 μm.

15. The micro-electro-mechanical system device of claim 12, wherein the second grid layer has a smaller mesh width than the first grid layer.

16. The micro-electro-mechanical system device of claim 12, wherein the second grid layer has a larger mesh width than the first grid layer.

17. The micro-electro-mechanical system device of claim 12, wherein the micro-electro-mechanical system structure is configured as a microphone or a loudspeaker.

18. The micro-electro-mechanical system device of claim 17, wherein the particle filter structure forms at least a portion of a backplate of the microphone or a loudspeaker.

19. The micro-electro-mechanical system device of claim 12, wherein the grid comprises silicon.

20. The micro-electro-mechanical system device of claim 12, wherein the particle filter structure is at least partially coated with a hydrophobic layer.

21. The micro-electro-mechanical system device of claim 12, wherein the particle filter structure is at least partially coated with a oleophobic layer.

22. A micro-electro-mechanical system device, comprising:

a carrier;

a particle filter structure coupled to the carrier, the particle filter structure comprising a silicon grid, wherein the silicon grid comprises a plurality of grid elements, each grid element comprising at least one through hole; and a micro-electro-mechanical system structure disposed over the particle filter structure, wherein the micro-electro-mechanical system structure comprises a plurality of electrodes and a membrane coupled to the plurality of electrodes;

wherein at least a portion of the grid element has a width in the range from about 0.3 μm to about 1 μm; and wherein at least a portion of the grid element has a height in the range from about 3 μm to about 20 μm, wherein the grid comprises a first grid layer and a second grid layer disposed over the first grid layer;

wherein the micro-electro-mechanical system structure is disposed on the same side as the second grid layer with respect to the first grid layer;

wherein the second grid layer has a greater width than the first grid layer.

23. The micro-electro-mechanical system device of claim 22, wherein the first grid layer has a width in the range from about 0.3 μm to about 1 μm.

24. The micro-electro-mechanical system device of claim 22, wherein the second grid layer has a width in the range from about 1 μm to about 3 μm.

25. The micro-electro-mechanical system device of claim 22, wherein the second grid layer has a height in the range from about 0.5 μm to about 5 μm.

26. The micro-electro-mechanical system device of claim 22, wherein at least a portion of the grid element has a height that is greater than its width by a factor of at least 2.

27. The micro-electro-mechanical system device of claim 22, wherein the micro-electro-mechanical system structure is configured as a microphone or a loudspeaker; and wherein the particle filter structure forms at least a portion of a backplate of the microphone or a loudspeaker.

28. The micro-electro-mechanical system device of claim 22, wherein the grid comprises polysilicon.

29. The micro-electro-mechanical system device of claim 22, wherein the particle filter structure is at least partially coated with a hydrophobic layer.

30. The micro-electro-mechanical system device of claim 22, wherein the particle filter structure is at least partially coated with a oleophobic layer.

* * * * *